US009368088B2

(12) United States Patent
Yano et al.

(10) Patent No.: US 9,368,088 B2
(45) Date of Patent: Jun. 14, 2016

(54) DISPLAY, IMAGE PROCESSING UNIT, IMAGE PROCESSING METHOD, AND ELECTRONIC APPARATUS

(71) Applicant: Sony Corporation, Tokyo (JP)

(72) Inventors: Tomoya Yano, Kanagawa (JP); Atsushi Ito, Kanagawa (JP); Ryo Ogawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 190 days.

(21) Appl. No.: 14/087,478

(22) Filed: Nov. 22, 2013

(65) Prior Publication Data

US 2014/0198140 A1 Jul. 17, 2014

(30) Foreign Application Priority Data

Jan. 11, 2013 (JP) ..... 2013-003597

(51) Int. Cl.
*G09G 5/02* (2006.01)
*G09G 5/10* (2006.01)
(Continued)

(52) U.S. Cl.
CPC ..... *G09G 5/10* (2013.01); *G09G 3/2074* (2013.01); *G09G 3/32* (2013.01);
(Continued)

(58) Field of Classification Search
CPC ..... G09G 5/06; G09G 2320/0666; G09G 2320/06; G09G 5/02; G09G 3/2003; G09G 3/3607; G09G 2300/0452; G09G 2320/0233; G09G 2340/06; G09G 2320/0209; G09G 5/10; G09G 3/2074; G09G 2360/16; G09G 2340/0435; G09G 2320/0273; G09G 3/32; G06T 11/001; H04N 1/60; H04N 1/6061; H04N 1/6005; H04N 1/6008; H04N 9/3179; H04N 9/3182; H04N 9/73; H04N 9/68; H04N 9/3185; H04N 9/3188
USPC ..... 345/696, 694, 690
See application file for complete search history.

(56) References Cited

U.S. PATENT DOCUMENTS 5,341,153 A * 8/1994 Benzschawel ..... G09G 3/2003 345/694
5,929,843 A * 7/1999 Tanioka ..... G09G 3/3607 345/600

(Continued)

FOREIGN PATENT DOCUMENTS

EP 1032045 A2 * 8/2000
JP 02-118521 5/1990

(Continued)

OTHER PUBLICATIONS

Klompenhouwer et al, "Subpixel Image Scaling for Color Matrix Displays", SID 02 Digest (2002), p. 176-179.*

*Primary Examiner* — Julie Anne Watko
(74) *Attorney, Agent, or Firm* — Chip Law Group

(57) ABSTRACT

An image processing method includes: obtaining, based on a plurality of pieces of first luminance information that correspond to fourth sub-pixels contained in a pixel region to which a focused pixel belongs and based on a relative positional relationship between a first sub-pixel and the fourth sub-pixel in a display pixel, second luminance information that corresponds to the fourth sub-pixel of the focused pixel, in which the focused pixel is a display pixel in a display section that includes a plurality of display pixels each having the first sub-pixel, a second sub-pixel, and a third sub-pixel that are configured to emit light of basic colors, and the fourth sub-pixel that is configured to emit light of a color other than the basic colors; and replacing the first luminance information that corresponds to the fourth sub-pixel of the focused pixel with the second luminance information.

13 Claims, 19 Drawing Sheets

(51) Int. Cl.
*G09G 3/20* (2006.01)
*G09G 3/32* (2016.01)

(52) U.S. Cl.
CPC ..... *G09G 2300/0452* (2013.01); *G09G 2320/0276* (2013.01); *G09G 2340/0435* (2013.01); *G09G 2340/06* (2013.01); *G09G 2360/16* (2013.01)

(56) References Cited

U.S. PATENT DOCUMENTS 7,123,277 B2 * 10/2006 Brown Elliott ..... G06T 3/4015 345/426
7,286,136 B2 * 10/2007 Phan ..... G09G 3/2003 345/55
7,530,722 B2 * 5/2009 Murai ..... G09G 3/3413 345/102
7,813,003 B2 * 10/2010 Lin ..... H04N 1/6008 345/600
7,920,154 B2 * 4/2011 Brown Elliott ..... G09G 5/02 345/690
7,994,712 B2 * 8/2011 Sung ..... H01L 27/3213 313/504
8,169,389 B2 * 5/2012 Cok ..... H04N 9/67 345/591
2004/0251820 A1 * 12/2004 Cok ..... H01L 27/3213 313/506
2005/0285828 A1 * 12/2005 Inoue ..... G09G 3/3208 345/76
2007/0242006 A1 * 10/2007 Lin ..... G09G 3/3225 345/82
2012/0313981 A1 * 12/2012 Ueki ..... G09G 3/3607 345/690
2014/0022271 A1 * 1/2014 Lin ..... G09G 3/36 345/589
2016/0027359 A1 * 1/2016 Guo ..... G09G 3/2003 345/694
2016/0027369 A1 * 1/2016 Guo ..... G09G 3/2003 345/694
2016/0042711 A1 * 2/2016 Kim ..... G09G 3/3688 345/691

FOREIGN PATENT DOCUMENTS

JP 04-54207 8/1992
JP 4434935 1/2010

* cited by examiner

DISPLAY, IMAGE PROCESSING UNIT, IMAGE PROCESSING METHOD, AND ELECTRONIC APPARATUS

CROSS REFERENCE TO RELATED APPLICATIONS

This application claims the benefit of Japanese Priority Patent Application JP 2013-3597 filed Jan. 11, 2013, the entire contents of each of which are incorporated herein by reference.

BACKGROUND

The present disclosure relates to a display that is configured to display images, an image processing unit and an image processing method to be used in such a display, and an electronic apparatus including such a display.

Recently, a cathode ray tube (CRT) display has been actively replaced with a liquid crystal display or an organic electro-luminescence (EL) display. The liquid crystal display and the organic EL display are each being a mainstream display due to low power consumption and a flat configuration thereof compared with the CRT display.

In some displays, each pixel is configured of four sub-pixels. For example, Japanese Examined Patent Application Publication No. H04-54207 discloses a liquid crystal display in which each pixel is configured of four sub-pixels of red (R), green (G), blue (B), and white (W). Japanese Patent No. 4434935 discloses an organic EL display in which each pixel is likewise configured of four sub-pixels. In such displays, for example, when white is displayed, for example, the white (W) sub-pixel is mainly allowed to emit light instead of the three sub-pixels of red (R), green (G), and blue (B), so that luminous efficiency is increased, and power consumption is reduced.

SUMMARY

Displays are generally desired to achieve high image quality, and are expected to be further improved in image quality.

It is desirable to provide a display, an image processing unit, an image processing method, and an electronic apparatus that are capable of improving image quality.

According to an embodiment of the present disclosure, there is provided a display including: a display section including a plurality of display pixels each having a first sub-pixel, a second sub-pixel, and a third sub-pixel that are configured to emit light of basic colors, and a fourth sub-pixel that is configured to emit light of a color other than the basic colors; and a processing section configured to obtain, based on a plurality of pieces of first luminance information that correspond to the fourth sub-pixels contained in a pixel region to which a focused pixel among the display pixels belongs and based on a relative positional relationship between the first sub-pixel and the fourth sub-pixel in the display pixel, second luminance information that corresponds to the fourth sub-pixel of the focused pixel, and configured to replace the first luminance information that corresponds to the fourth sub-pixel of the focused pixel with the second luminance information.

According to an embodiment of the present disclosure, there is provided an image processing unit including a processing section configured to obtain, based on a plurality of pieces of first luminance information that correspond to fourth sub-pixels contained in a pixel region to which a focused pixel belongs and based on a relative positional relationship between a first sub-pixel and the fourth sub-pixel in a display pixel, second luminance information that corresponds to the fourth sub-pixel of the focused pixel, in which the focused pixel is a display pixel in a display section that includes a plurality of display pixels each having the first sub-pixel, a second sub-pixel, and a third sub-pixel that are configured to emit light of basic colors, and the fourth sub-pixel that is configured to emit light of a color other than the basic colors, and configured to replace the first luminance information that corresponds to the fourth sub-pixel of the focused pixel with the second luminance information.

According to an embodiment of the present disclosure, there is provided an image processing method including: obtaining, based on a plurality of pieces of first luminance information that correspond to fourth sub-pixels contained in a pixel region to which a focused pixel belongs and based on a relative positional relationship between a first sub-pixel and the fourth sub-pixel in a display pixel, second luminance information that corresponds to the fourth sub-pixel of the focused pixel, in which the focused pixel is a display pixel in a display section that includes a plurality of display pixels each having the first sub-pixel, a second sub-pixel, and a third sub-pixel that are configured to emit light of basic colors, and the fourth sub-pixel that is configured to emit light of a color other than the basic colors; and replacing the first luminance information that corresponds to the fourth sub-pixel of the focused pixel with the second luminance information.

According to an embodiment of the present disclosure, there is provided an electronic apparatus provided with a display and a control section configured to perform operation control on the display. The display includes: a display section including a plurality of display pixels each having a first sub-pixel, a second sub-pixel, and a third sub-pixel that are configured to emit light of basic colors, and a fourth sub-pixel that is configured to emit light of a color other than the basic colors; and a processing section configured to obtain, based on a plurality of pieces of first luminance information that correspond to the fourth sub-pixels contained in a pixel region to which a focused pixel among the display pixels belongs and based on a relative positional relationship between the first sub-pixel and the fourth sub-pixel in the display pixel, second luminance information that corresponds to the fourth sub-pixel of the focused pixel, and configured to replace the first luminance information that corresponds to the fourth sub-pixel of the focused pixel with the second luminance information.

Examples of the electronic apparatus may include a television unit, a digital camera, a personal computer, a video camera, and a portable terminal unit such as a mobile phone.

In the display, the image processing unit, the image processing method, and the electronic apparatus according to the above-described respective embodiments of the present disclosure, the fourth sub-pixels in the display section perform display based on the second luminance information. The second luminance information of the focused pixel is obtained based on the plurality of pieces of first luminance information corresponding to the plurality of fourth sub-pixels contained in the pixel region to which the focused pixel belongs, and on the relative positional relationship between the first sub-pixel and the fourth sub-pixel in the display pixel. The first luminance information of the focused pixel is replaced with the second luminance information.

According to the display, the image processing unit, the image processing method, and the electronic apparatus of the above-described respective embodiments of the present disclosure, the second luminance information of the focused pixel is obtained based on the plurality of pieces of first luminance information that correspond to the plurality of fourth sub-pixels contained in the pixel region to which the focused pixel belongs, and based on the relative positional relationship between the first sub-pixel and the fourth sub-pixel in the display pixel, and the first luminance information of the focused pixel is replaced with the second luminance information. Therefore, it is possible to improve image quality.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

DETAILED DESCRIPTION

Hereinafter, some embodiments of the present disclosure will be described in detail with reference to the accompanying drawings. It is to be noted that description is made in the following order.

1. First Embodiment
2. Second Embodiment
3. Application examples

1. First Embodiment

Exemplary Configuration (Exemplary Overall Configuration)

Figure 1:
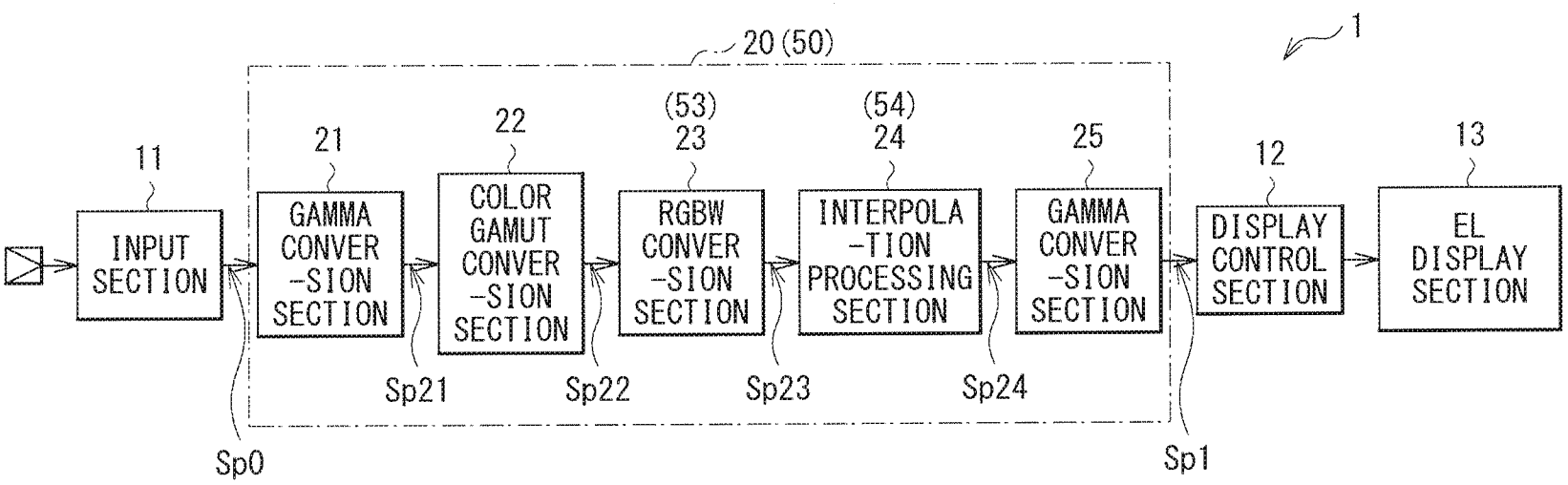
FIG. 1 is a block diagram illustrating an exemplary configuration of a display according to a first embodiment of the present disclosure.

FIG. 1 illustrates an exemplary configuration of a display according to a first embodiment. The display 1 may be an EL display using an organic EL display device as a display device. It is to be noted that since an image processing unit, image processing method, and an electronic apparatus according to respective example embodiments of the disclosure are embodied by the first embodiment, they are described together. The display 1 includes an input section 11, an image processing section 20, a display control section 12, and an EL display section 13.

The input section 11 is an input interface that is configured to generate an image signal Sp0 based on an image signal supplied from an external unit. In this exemplary case, the image signal supplied to the display 1 is a so-called RGB signal containing red (R) luminance information IR, green (G) luminance information IG, and blue (B) luminance information IB.

As described later, the image processing section 20 performs predetermined image processing such as RGBW conversion processing and interpolation processing on the image signal Sp0 to generate an image signal Sp1.

The display control section 12 is configured to perform timing control of display operation of the EL display section 13 based on the image signal Sp1. The EL display section 13 is a display section using an organic EL display device as a display device, and is configured to perform display operation based on control by the display control section 12.

Figure 2:
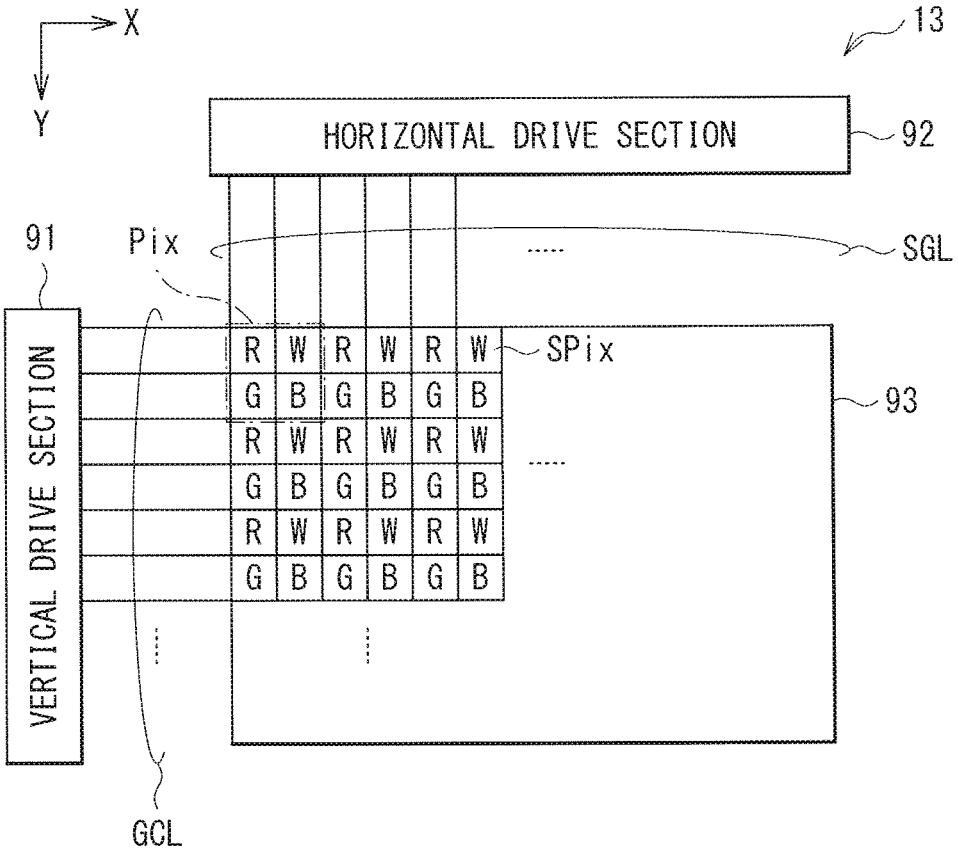
FIG. 2 is a block diagram illustrating an exemplary configuration of an EL display section illustrated in FIG. 1.

FIG. 2 illustrates an exemplary configuration of the EL display section 13. The EL display section 13 includes a pixel array section 93, a vertical drive section 91, and a horizontal drive section 92.

The pixel array section 93 includes pixels Pix arranged in a matrix. In this exemplary case, each pixel Pix is configured of four sub-pixels of red (R), green (G), blue (B), and white (W). In each pixel Pix in this exemplary case, such four sub-pixels are arranged in a two-row-two-column pattern. Specifically, in the pixel Pix, a red (R) sub-pixel SPix is disposed at the upper left, a green (G) sub-pixel SPix is disposed at the lower left, a white (W) sub-pixel SPix is disposed at the upper right, and a blue (B) sub-pixel SPix is disposed at the lower right.

Colors of the four sub-pixels SPix are not limited thereto. For example, a sub-pixel SPix of another color, the luminosity factor for which is high as for white, may be used in place of the white sub-pixel SPix. More specifically, a sub-pixel SPix of a color (for example, yellow) may be preferably used, the luminosity factor for the color being equal to or higher than the luminosity factor for green that is highest among luminosity factors for red, green, and blue.

The vertical drive section 91 is configured to generate a scan signal based on timing control by the display control section 12, and supplies the scan signal to the pixel array section 93 through a gate line GCL to sequentially select the sub-pixels SPix in the pixel array section 93 for line-sequential scan. The horizontal drive section 92 is configured to generate a pixel signal based on timing control by the display control section 12, and supplies the pixel signal to the pixel array section 93 through a data line SGL to supply the pixel signal to each of the sub-pixels SPix in the pixel array section 93.

The display 1 displays an image with the four sub-pixels SPix in this way, thereby allowing reduction in power consumption. Specifically, for example, in the case where white is displayed in a display having three sub-pixels of red, green, and blue, such three sub-pixels may be allowed to emit light. In contrast, in the display 1, the white sub-pixel is mainly allowed to emit light instead, thereby making it possible to reduce power consumption.

(Image Processing Section 20)

The image processing section 20 includes a gamma conversion section 21, a color gamut conversion section 22, an RGBW conversion section 23, an interpolation processing section 24, and a gamma conversion section 25.

The gamma conversion section 21 is configured to convert the received image signal Sp0 into an image signal Sp21 having linear gamma characteristics. Specifically, an image signal supplied from outside has a gamma value set to, for example, 2.2 in correspondence to characteristics of a common display, and thus has nonlinear gamma characteristics. The gamma conversion section 21 therefore converts such nonlinear gamma characteristics into linear gamma characteristics to facilitate processing by the image processing section 20. For example, the gamma conversion section 21 may include a lookup table, and may perform such gamma conversion using the lookup table.

The color gamut conversion section 22 is configured to convert a color gamut and color temperature represented by the image signal Sp21 into a color gamut and color temperature, respectively, of the EL display section 13 to generate an image signal Sp22. Specifically, the color gamut conversion section 22 is configured to perform color gamut conversion and color temperature conversion through, for example, 3×3 matrix conversion. For example, in an application where the conversion of the color gamut is not necessary such as the case where the color gamut of the input signal corresponds to the color gamut of the EL display section 13, only the conversion of the color temperature may be performed through processing using a coefficient for correction of color temperature.

The RGBW conversion section 23 is configured to generate an RGBW signal based on the image signal Sp22 as an RGB signal, and outputs the RGBW signal as an image signal Sp23. Specifically, the RGBW conversion section 23 is configured to convert an RGB signal containing three colors of red (R), green (G), and blue (B) of luminance information IR, IG, and IB into an RGBW signal containing four colors of red (R), green (G), blue (B), and white (W) of luminance information IR2, IG2, IB2, and IW2.

Figure 3:
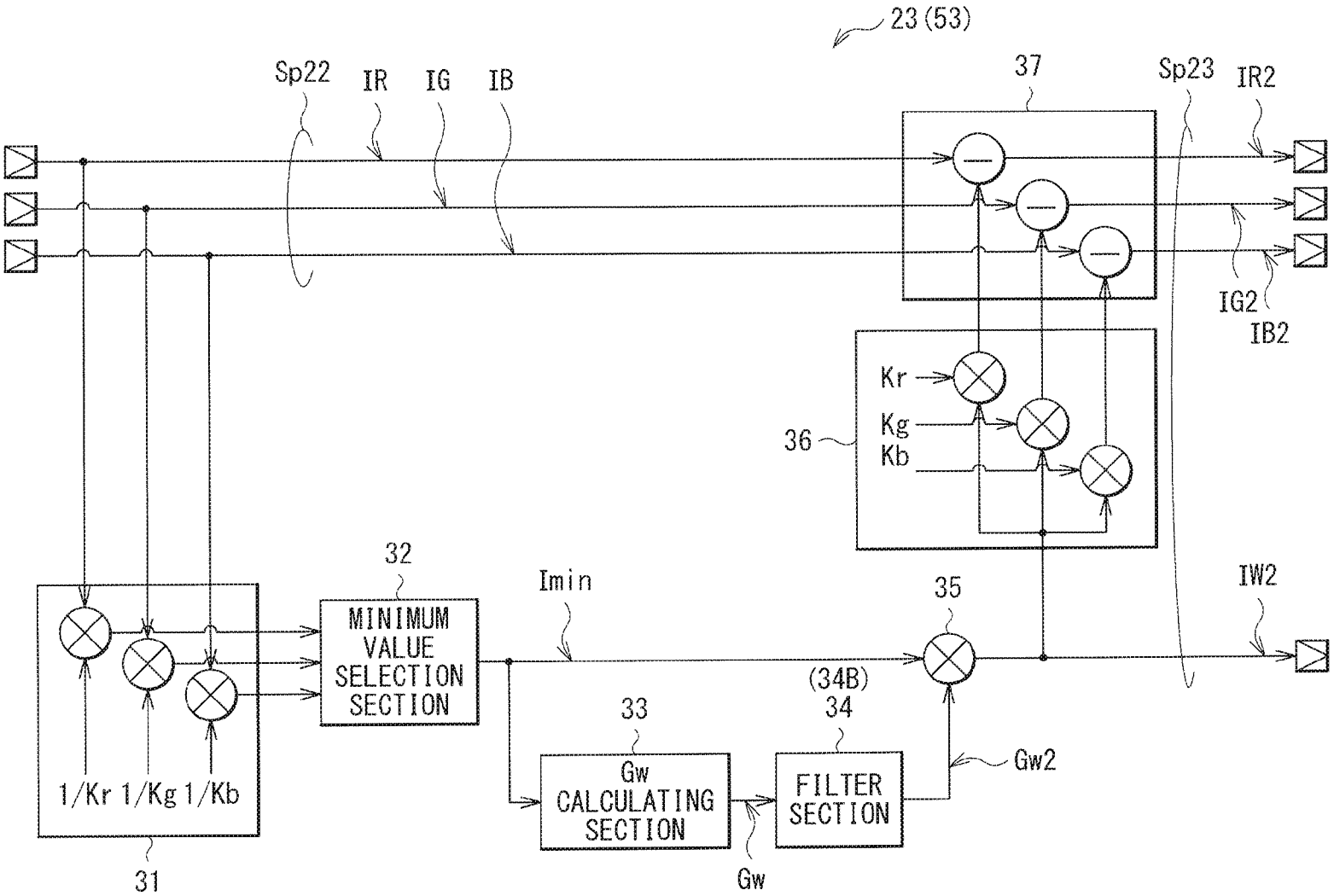
FIG. 3 is a block diagram illustrating an exemplary configuration of an RGBW conversion section illustrated in FIG. 1.

FIG. 3 illustrates an exemplary configuration of the RGBW conversion section 23. The RGBW conversion section 23 includes a multiplication section 31, a minimum value selection section 32, a Gw calculating section 33, a filter section 34, multiplication sections 35 and 36, and a subtraction section 37.

The multiplication section 31 is configured to multiply each of pieces of luminance information IR, IG, and IB of each pixel contained in the image signal Sp22 by a predetermined constant. Specifically, the multiplication section 31 multiplies the luminance information IR by a constant "1/Kr", multiplies the luminance information IG by a constant "1/Kg", and multiplies the luminance information IB by a constant "1/Kb". Kr represents a luminance value of a red (R) component of light, which is provided when the white (W) sub-pixel SPix is allowed to emit light at a maximum luminance, with reference to the maximum luminance value of the red (R) sub-pixel SPix. Similarly, Kg represents a luminance value of a green (G) component of light, which is provided when the white (W) sub-pixel SPix is allowed to emit light at a maximum luminance, with reference to the maximum luminance of the green (G) sub-pixel SPix. Kb represents a luminance value of a blue (B) component of light, which is provided when the white (W) sub-pixel SPix is allowed to emit light at a maximum luminance, with reference to the maximum luminance of the blue (B) sub-pixel SPix.

The minimum value selection section 32 is configured to select one having a minimum value among the three multiplication results supplied from the multiplication section 31, and outputs the selected multiplication result as a parameter Imin.

The Gw calculating section 33 is configured to calculate a W conversion rate Gw of each pixel based on the parameter Imin of that pixel. The W conversion rate Gw indicates a rate at which the white (W) sub-pixel SPix is allowed to emit light, and has a value of 0 to 1 both inclusive in this exemplary case. In this exemplary case, the Gw calculating section 33 has a lookup table, and calculates the W conversion rate Gw for each pixel using the lookup table.

Figure 4:
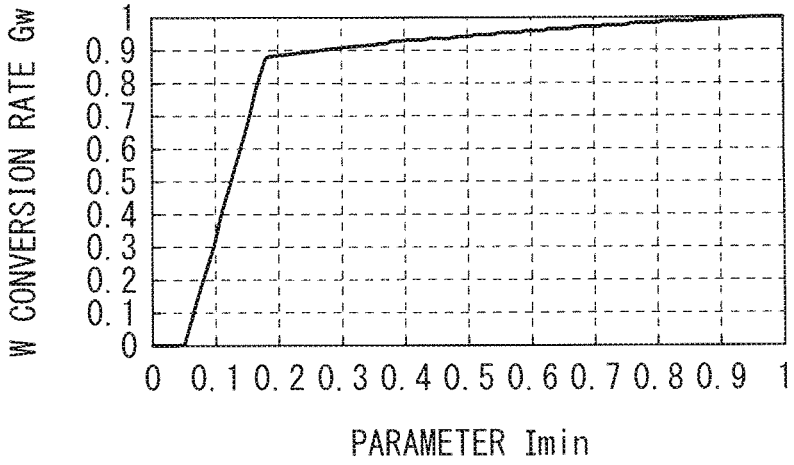
FIG. 4 is an explanatory diagram explaining a lookup table of a Gw calculating section illustrated in FIG. 3.

FIG. 4 illustrates characteristics of the lookup table of the Gw calculating section 33. The parameter Imin is normalized in this exemplary case. Specifically, the minimum value of the parameter Imin is represented as "0", while the maximum thereof is represented as "1". In the lookup table of the Gw calculating section 33, the W conversion rate Gw is low in case of a low parameter Imin, but is high in case of a high parameter Imin.

The filter section 34 is configured to smooth the W conversion rate Gw for each pixel supplied from the Gw calculating section 33 in horizontal and vertical directions in a frame image F, and output the smoothed W conversion rate as a W conversion rate Gw2 for each pixel. Specifically, for example, the filter section 34 may be configured of a finite impulse response (FIR) filter.

The multiplication section 35 is configured to generate luminance information IW2 through multiplication of the parameter Imin by the W conversion rate Gw2.

The multiplication section 36 is configured to multiply the luminance information IW2 by each of the constants Kr, Kg, and Kb. Specifically, the multiplication section 36 multiplies the luminance information IW2 by the constant Kr (IW2×Kr), multiplies the luminance information IW2 by the constant Kg (IW2×Kg), and multiplies the luminance information IW2 by the constant Kb (IW2×Kb).

The subtraction section 37 is configured to subtract one (IW2×Kr) of the multiplication results given by the multiplication section 36 from the luminance information IR contained in the image signal Sp22 to generate the luminance information IR2, subtract one (IW2×Kg) of the multiplication results given by the multiplication section 36 from the luminance information IG contained in the image signal Sp22 to generate the luminance information IG2, and subtract one (IW2×Kb) of the multiplication results given by the multiplication section 36 from the luminance information IB contained in the image signal Sp22 to generate the luminance information IB2.

Figure 5A:
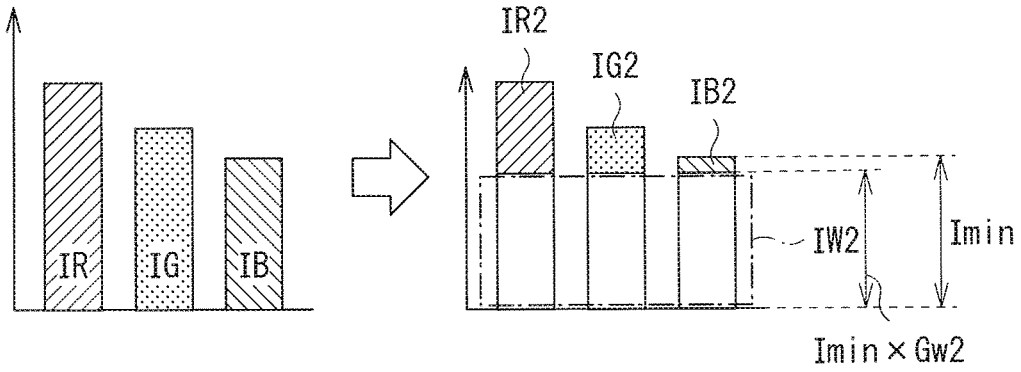
FIG. 5A is an explanatory diagram illustrating exemplary operation of the RGBW conversion section illustrated in FIG. 1.
Figure 5B:
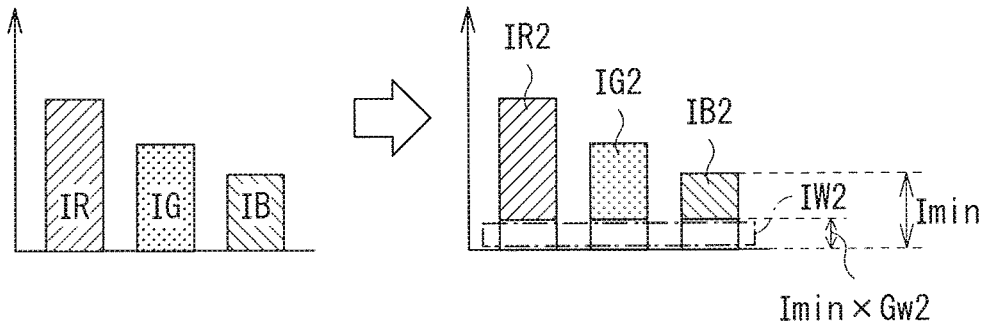
FIG. 5B is an explanatory diagram illustrating another type of exemplary operation of the RGBW conversion section illustrated in FIG. 1.

FIG. 5A illustrates an example of RGBW conversion by the RGBW conversion section 23, and FIG. 5B illustrates another example of the RGBW conversion. Hereinafter, each of the constants Kr, Kg, and Kb is assumed to be "1" for convenience of description.

In the example illustrated in FIG. 5A, the luminance information IB has a lowest luminance level among the pieces of luminance information IR, IG, and IB; hence, the minimum value selection section 32 selects the luminance information IB as the parameter Imin. The Gw calculating section 33 obtains a W conversion rate Gw using the lookup table as illustrated in FIG. 4 based on the parameter Imin, and the filter section 34 smooths the W conversion rate Gw to generate a W conversion rate Gw2. The multiplication section 35 multiplies the parameter Imin by the W conversion rate Gw2 (Imin×Gw2) to generate luminance information IW2.

In the example illustrated in FIG. 5B, as with FIG. 5A, the minimum value selection section 32 selects the luminance information IB as the parameter Imin, and the Gw calculating section 33 obtains a W conversion rate Gw based on the parameter Imin, and the filter section 34 smooths the W conversion rate Gw to generate a W conversion rate Gw2. Here, since the parameter Imin is low compared with a case of FIG. 5A, the W conversion rate Gw calculated by the Gw calculating section 33 is also low, and the W conversion rate Gw2 is also low. The multiplication section 35 multiplies the parameter Imin by such a low W conversion rate Gw2 to generate luminance information IW2.

In this way, in the case of a low parameter Imin (FIG. 5B), the Gw calculating section 33 lowers a rate (the W conversion rate Gw), at which the white sub-pixel SPix is allowed to emit light, compared with the case of a high parameter Imin (FIG. 5A). In addition, the filter section 34 smooths the W conversion rate Gw for each pixel supplied from the Gw calculating section 33 in horizontal and vertical directions in a frame image F. Consequently, as described later, when a display image has a green region and a white region, and even if a bright line or a dark line appears in the neighborhood of the boundary between the regions, such a bright or dark line is allowed to be less noticeable.

The interpolation processing section 24 is configured to interpolate each luminance information IW2 contained in the image signal Sp23 using luminance information IW2 of each of pixels arranged in horizontal and vertical directions with respect to a focused pixel in a frame image F. Specifically, as described later, the interpolation processing section 24 creates a luminance information map MAP in which the luminance information IW2 of a white (W) sub-pixel SPix is disposed at a position of a sub-pixel SPix of green (G) the luminosity factor for which is high as for white, and generates luminance information IW3 at a position of the white (W) sub-pixel SPix based on the luminance information map MAP. The interpolation processing section 24 outputs the luminance information IW3 generated in this way and the pieces of luminance information IR2, IG2, and IB2, in a form of an image signal Sp24.

The interpolation processing is performed in this way, which allows the display 1 to reduce a possibility of formation of a bright line or a dark line in the neighborhood of the boundary between green and white regions, as described later.

The gamma conversion section 25 is configured to convert the image signal Sp24 having linear gamma characteristics into the image signal Sp1 having nonlinear gamma characteristics corresponding to the characteristics of the EL display section 13. The gamma conversion section 25 may include, for example, a lookup table as with the gamma conversion section 21, and may perform such gamma conversion using the lookup table.

The EL display section 13 corresponds to a specific but not limitative example of "display section" in one embodiment of the disclosure. The interpolation processing section 24 corresponds to a specific but not limitative example of "processing section" in one embodiment of the disclosure. The luminance information IW2 contained in the image signal Sp23 corresponds to a specific but not limitative example of "first luminance information" in one embodiment of the disclosure. The luminance information IW3 contained in the image signal Sp24 corresponds to a specific but not limitative example of "second luminance information" in one embodiment of the disclosure. The RGBW conversion section 23 corresponds to a specific but not limitative example of "luminance information generation section" in one embodiment of the disclosure. The pieces of luminance information IR, IG, and IB contained in the image signal Sp22 correspond to a specific but not limitative example of "three pieces of first basic luminance information" in one embodiment of the disclosure. The W conversion rate Gw corresponds to a specific but not limitative example of "light emission rate" in one embodiment of the disclosure. The pieces of luminance information IR2, IG2, and IB2 contained in the image signal Sp23 correspond to a specific but not limitative example of "three pieces of second basic luminance information" in one embodiment of the disclosure.

[Operation and Functions]

Operation and functions of the display 1 according to the first embodiment are now described.

(Summary of Overall Operation)

Summary of overall operation of the display 1 is now described with reference to FIG. 1, etc. The input section 11 generates the image signal Sp0 based on an image signal supplied from an external unit. The gamma conversion section 21 converts the received image signal Sp0 into the image signal Sp21 having linear gamma characteristics. The color gamut conversion section 22 converts the color gamut and the color temperature represented by the image signal Sp21 into the color gamut and the color temperature, respectively, of the EL display section 13 to generate the image signal Sp22. The RGBW conversion section 23 generates an RGBW signal based on the image signal Sp22 as an RGB signal, and outputs the RGBW signal as the image signal Sp23. The interpolation processing section 24 performs interpolation processing on the luminance information IW2 contained in the image signal Sp23 in a frame image F to generate the image signal Sp24. The gamma conversion section 25 converts the image signal Sp24 having the linear gamma characteristics into the image signal Sp1 having the nonlinear gamma characteristics corresponding to the characteristics of the EL display section 13. The display control section 12 performs timing control of display operation of the EL display section 13 based on the image signal Sp1. The EL display section 13 performs display operation based on the timing control by the display control section 12.

(Processing by RGBW Conversion Section 23)

In the RGBW conversion section 23, the multiplication section 31 multiplies the pieces of luminance information IR, IG, and IB by the constants "1/Kr", "1/Kg", and "1/Kb", respectively, and the minimum value selection section 32 selects one having a minimum value, as the parameter Imin, among the multiplication results. The Gw calculating section 33 obtains the W conversion rate Gw using the lookup table as illustrated in FIG. 4 based on the parameter Imin, and the filter section 34 smooths the W conversion rate Gw in horizontal and vertical directions in a frame image F to generate the W conversion rate Gw2. The multiplication section 35 multiplies the parameter Imin by the W conversion rate Gw2 to generate the luminance information IW2.

The multiplication section 36 multiplies the luminance information IW2 by each of the constants Kr, Kg, and Kb. The subtraction section 37 subtracts one (IW2×Kr) of the multiplication results by the multiplication section 36 from the luminance information IR to generate the luminance information IR2, subtracts one (IW2×Kg) of the multiplication results by the multiplication section 36 from the luminance information IG to generate the luminance information IG2, and subtracts one (IW2×Kb) of the multiplication results by the multiplication section 36 from the luminance information IB to generate the luminance information IB2.

A specific but not limitative example of processing by the RGBW conversion section 23 is now described with an exemplary frame image F.

Figure 6:
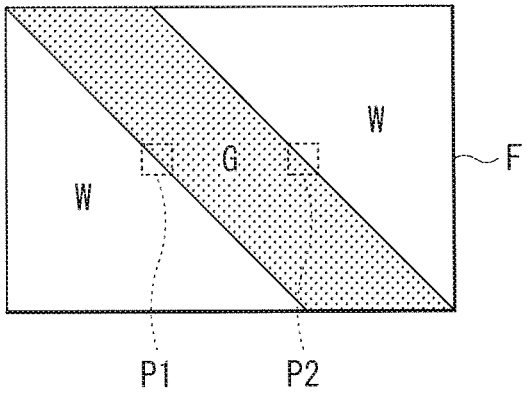
FIG. 6 is an explanatory diagram illustrating an example of a frame image.

FIG. 6 illustrates an exemplary frame image F to be displayed. The frame image F shows green over a region from upper left to lower right, and shows white in other regions. Description is now made on processing operation of the RGBW conversion section 23 on each of boundary portions P1 and P2 between the green region and the white region. First, processing operation on the boundary portion P1 is described.

Figure 7:
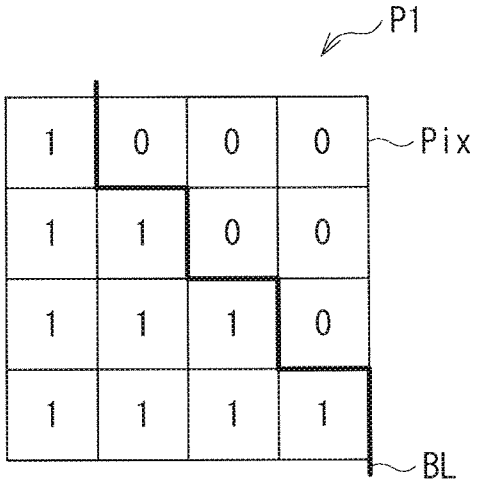
FIG. 7 is an explanatory diagram for explaining exemplary operation of the Gw calculating section illustrated in FIG. 1.

FIG. 7 illustrates an example of the W conversion rate Gw at the boundary portion P1. In this example, since white is displayed in the left side of a boundary BL, the W conversion rate Gw is "1" in the left side. Specifically, white means that each of pieces of luminance information IR, IG, and IB has a high value, and thus the parameter Imin has a high value. Consequently, the Gw calculating section 33 obtains a high W conversion rate Gw (in this example, "1") based on such a high parameter Imin. On the other hand, since green is displayed in the right side of the boundary BL, the W conversion rate Gw is "0" in the right side. Specifically, green means that luminance information IG has a high value, and each of pieces of luminance information IR and IB has a low value, and thus the parameter Imin has a low value. Consequently, the Gw calculating section 33 obtains a low W conversion rate Gw (in this example, "0") based on such a low parameter Imin.

Figure 8:
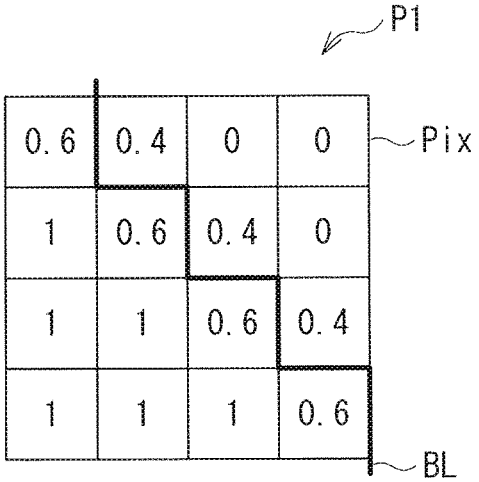
FIG. 8 is an explanatory diagram for explaining exemplary operation of a filter section illustrated in FIG. 1.

FIG. 8 illustrates an example of the W conversion rate Gw2 in the boundary portion P1. In this example, each pixel Pix close to the boundary has a W conversion rate Gw2 having a value close to an intermediate value between "1" and "0". In this way, the filter section 34 smooths the W conversion rate Gw in the frame image F to obtain the W conversion rate Gw2, and thus operates so as to suppress a drastic variation of the W conversion rate Gw2 in the frame image F.

Figure 9:
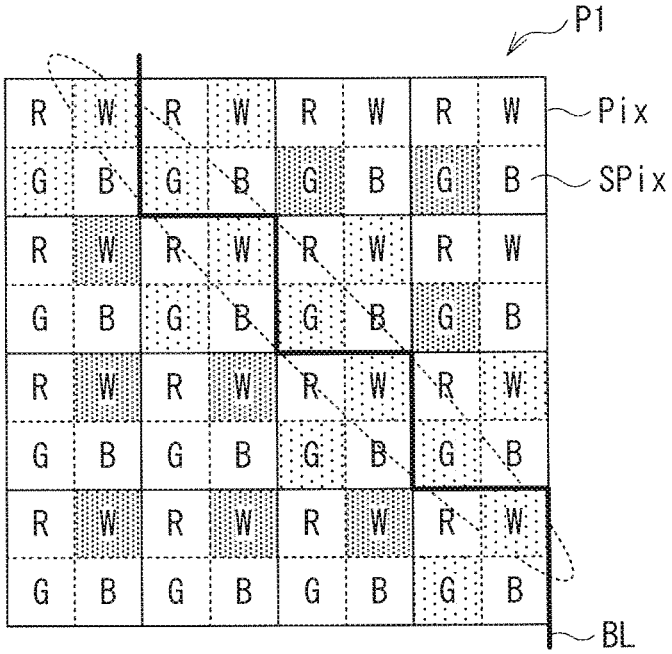
FIG. 9 is an explanatory diagram for explaining exemplary operation of a sub-pixel after a smoothing process.

FIG. 9 illustrates luminance of each sub-pixel SPix in the boundary portion P1. In FIG. 9, a shaded sub-pixel SPix indicates a sub-pixel SPix that emits light. In the left side where white is displayed, each white (W) sub-pixel SPix mainly emits light in a portion where the W conversion rate Gw2 (FIG. 8) is "1". Similarly, in the right side where green is displayed, each green (G) sub-pixel SPix mainly emits light in a portion where the W conversion rate Gw2 (FIG. 8) is "0". On the other hand, in a pixel Pix close to the boundary, since the W conversion rate Gw2 has a value close to an intermediate value between "1" and "0" (FIG. 8), each of the white (W) and green (G) sub-pixels SPix emits light at a medium luminance. In the pixel Pix close to the boundary, each of undepicted red (R) and blue (B) sub-pixels SPix also emits light at a luminance corresponding to the W conversion rate Gw2 thereof.

Subsequently, processing operation on the boundary portion P2 is described.

Figure 10:
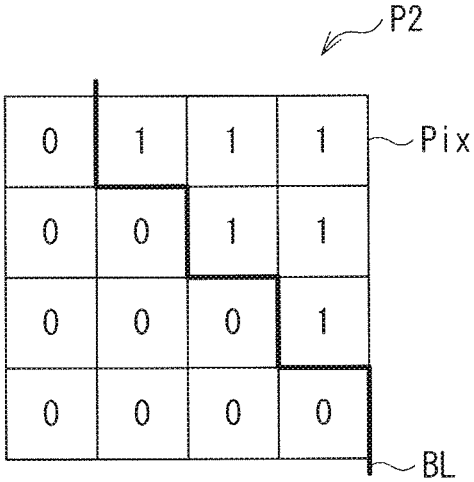
FIG. 10 is an explanatory diagram for explaining another type of exemplary operation of the Gw calculating section illustrated in FIG. 1.
Figure 11:
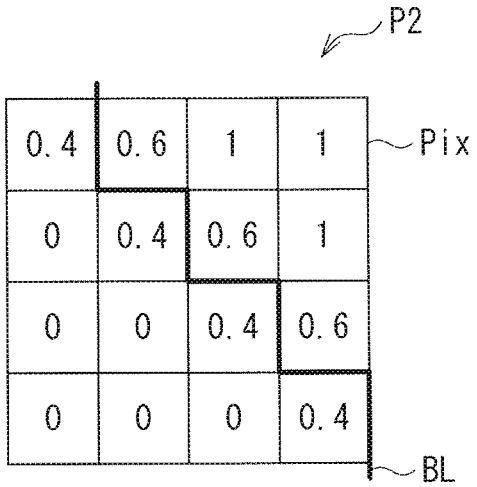
FIG. 11 is an explanatory diagram for explaining another type of exemplary operation of the filter section illustrated in FIG. 1.

FIG. 10 illustrates an exemplary W conversion rate Gw in the boundary portion P2. FIG. 11 illustrates an exemplary W conversion rate Gw2 in the boundary portion P2. As illustrated in FIG. 10, in this exemplary case, since green is displayed in the left side of the boundary BL, the W conversion rate Gw is "0" in the left side, and since white is displayed in the right side of the boundary BL, the W conversion rate Gw is "1" in the right side. As illustrated in FIG. 11, each pixel Pix close to the boundary has a W conversion rate Gw2 having a value close to an intermediate value between "1" and "0".

Figure 12:
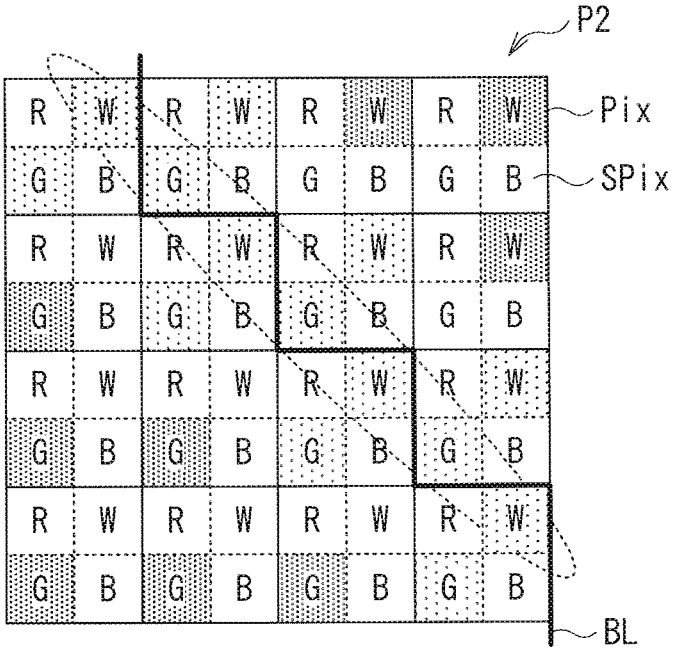
FIG. 12 is an explanatory diagram for explaining another type of exemplary operation of a sub-pixel after a smoothing process.

FIG. 12 illustrates luminance of each sub-pixel SPix in the boundary portion P2. In the left side of the boundary BL, each green (G) sub-pixel SPix mainly emits light in a portion where the W conversion rate Gw2 (FIG. 11) is "0". Similarly, in the right side of the boundary BL, each white (W) sub-pixel SPix mainly emits light in a portion where the W conversion rate Gw2 (FIG. 11) is "1". On the other hand, in a pixel Pix close to the boundary, since the W conversion rate Gw2 has a value close to an intermediate value between "1" and "0" (FIG. 11), each of the white (W) and green (G) sub-pixels SPix emits light at a medium luminance. In the pixel Pix close to the boundary, each of undepicted red (R) and blue (B)

sub-pixels SPix also emits light at a luminance corresponding to the W conversion rate Gw2 thereof.

In this way, in the display 1, the W conversion rate Gw is obtained for each pixel based on the parameter Imin, and the W conversion rate Gw is smoothed within a frame image F. Consequently, each white (W) sub-pixel SPix and each green (G) sub-pixel SPix emit light at luminance levels substantially equal to each other in the neighborhood of the boundary between the green region and the white region. On the other hand, each white (W) sub-pixel SPix mainly emits light in the white region, while each green (G) sub-pixel SPix emits light in the green region. Specifically, the RGBW conversion section 23 obtains the W conversion rate Gw for each pixel, and smooths the W conversion rate Gw in the frame image F, and thus equivalently detects the boundary between the green region and the white region, and allows the white (W) sub-pixel SPix and the green (G) sub-pixel SPix to emit light at luminance levels substantially equal to each other in the neighborhood of the boundary. This makes it possible to improve image quality as described below in comparison with a comparative example.

Comparative Example

Effects according to the first embodiment of the present technology are now described in comparison with a comparative example.

Figure 13:
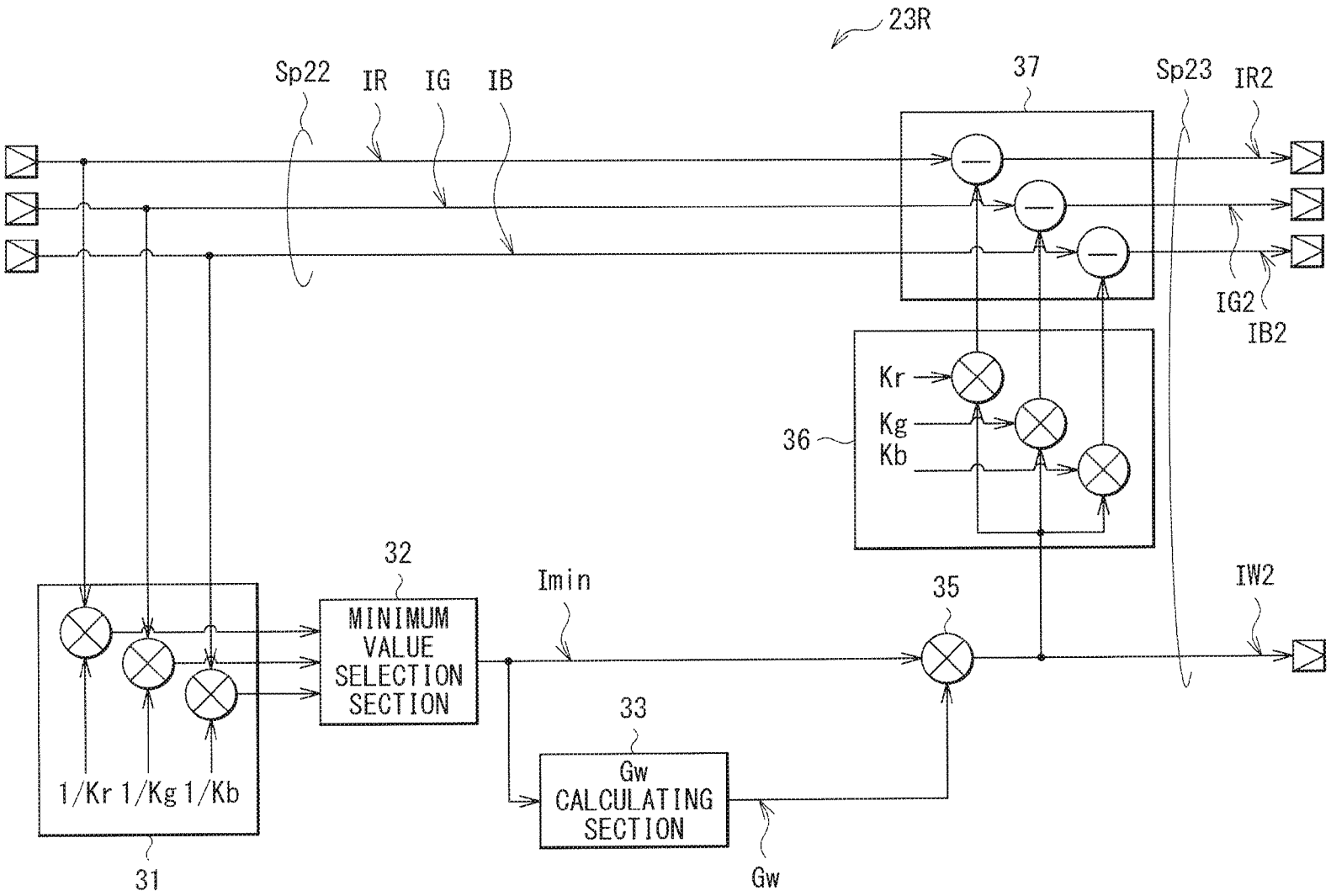
FIG. 13 is a block diagram illustrating an exemplary configuration of an RGBW conversion section according to a comparative example.

FIG. 13 illustrates an exemplary configuration of an RGBW conversion section 23R according to the comparative example. The RGBW conversion section 23R has the same configuration as that of the RGBW conversion section 23 (FIG. 3) according to the first embodiment except for including no filter section 34. In this configuration, the multiplication section 35 multiplies the parameter Imin by the W conversion rate Gw calculated by the Gw calculating section 33 to generate the luminance information IW2.

Figure 14:
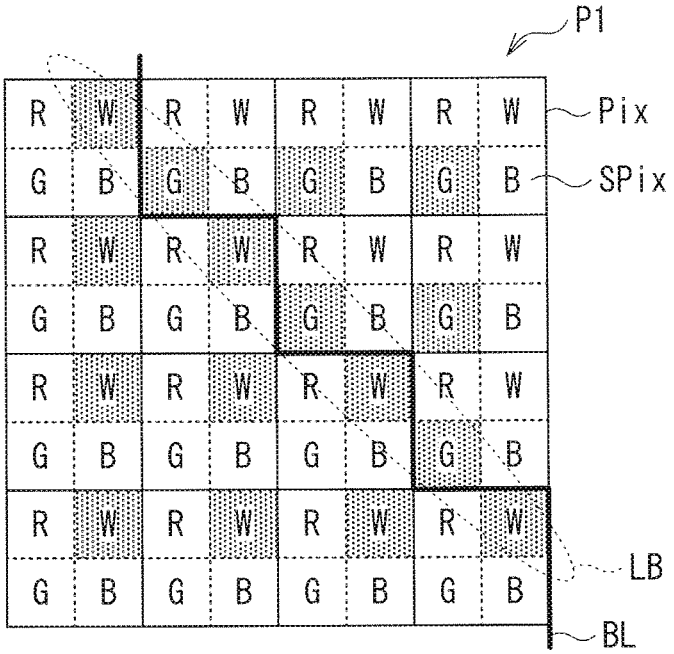
FIG. 14 is an explanatory diagram for explaining exemplary operation of a sub-pixel according to the comparative example.

FIG. 14 illustrates luminance of each sub-pixel SPix in the boundary portion P1. In the boundary portion P1, as illustrated in FIG. 14, each white (W) sub-pixel SPix mainly emits light in the left side of the boundary BL, while each green (G) sub-pixel SPix mainly emits light in the right side of the boundary BL. The white (W) sub-pixel SPix is located at the upper right of a pixel Pix, and the green (G) sub-pixel SPix is located at the lower left thereof. Hence, in the case where the boundary BL extends from the upper left to the lower right as in the drawing, a bright line LB may be formed along the boundary BL as illustrated in FIG. 14.

Figure 15:
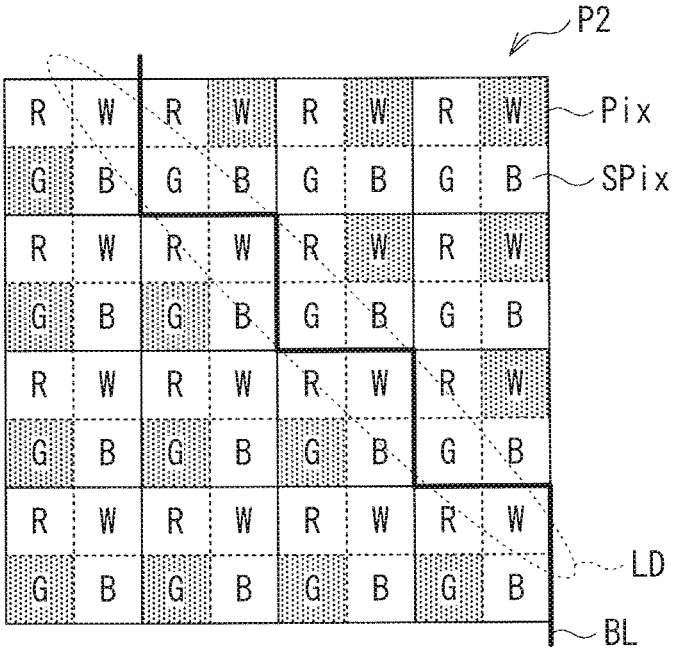
FIG. 15 is an explanatory diagram for explaining another type of exemplary operation of a sub-pixel according to the comparative example.

FIG. 15 illustrates luminance of each sub-pixel SPix in the boundary portion P2. In the boundary portion P2, as illustrated in FIG. 15, each green (G) sub-pixel SPix mainly emits light in the left side where green is displayed, and each white (W) sub-pixel SPix mainly emits light in the right side where white is displayed. In this case, as illustrated in FIG. 15, a dark line LD may be formed along the boundary.

In particular, since white and green are colors for each of which the luminosity factor is high, if the bright line LB or the dark line LD is formed as illustrated in FIG. 14 or 15, such a line is easily noticeable to a viewer. Consequently, a viewer viewing such an image may find the image quality to be bad.

Moreover, for example, in the case illustrated in FIG. 15, each green (G) sub-pixel SPix mainly emits light in the left side of the boundary BL, and each white (W) sub-pixel SPix mainly emits light in the right side of the boundary BL. Hence, such sub-pixels may be seen as discontinuous dots, leading to reduction in smoothness of an image.

In contrast, in the RGBW conversion section 23 according to the first embodiment, the W conversion rate Gw is smoothed in the frame image F. This allows each white (W) sub-pixel SPix and each green (G) sub-pixel SPix to emit light at luminance levels substantially equal to each other in the neighborhood of the boundary between the green region and the white region. Consequently, as illustrated in FIGS. 9 and 12, luminance is dispersed over a plurality of sub-pixels SPix in the neighborhood of the boundary, thus allowing the bright line LB or the dark line LD to be less noticeable, and allowing image quality to be improved. In addition, since the white (W) sub-pixels SPix and the green (G) sub-pixels SPix emit light together, resolution is equivalently increased compared with the case of the comparative example (FIG. 15), thus allowing a display image to be further smooth, and allowing image quality to be improved.

(Interpolation Processing by Interpolation Processing Section 24)

The interpolation processing section 24 interpolates the luminance information IW2 contained in the image signal Sp23 in a frame image F. Such interpolation processing is now described in detail.

Figure 16:
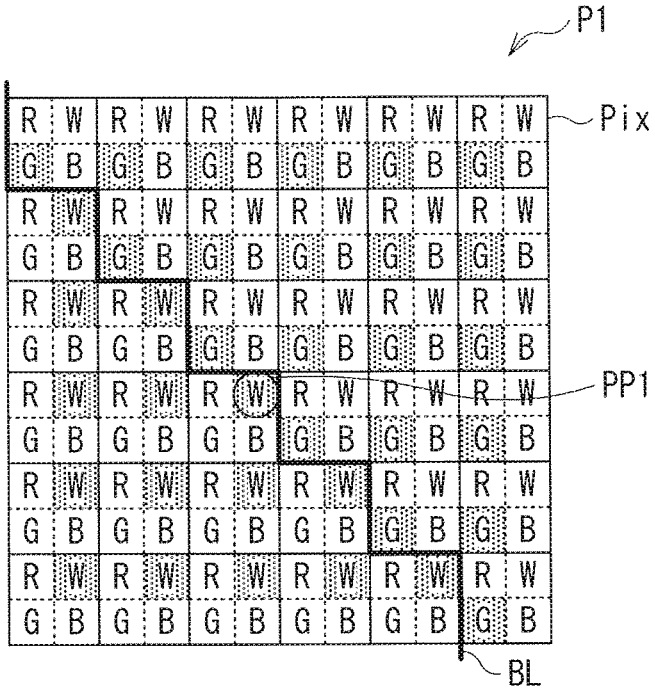
FIG. 16 is an explanatory diagram illustrating an exemplary map of luminance information.

FIG. 16 illustrates an exemplary map of pieces of luminance information IR2, IG2, IB2, and IW2 in the boundary portion P1. In this exemplary case, the filter section 34 of the RGBW conversion section 23 is assumed to perform no smoothing process for convenience of description. Each shaded portion indicates that each of pieces of luminance information IR2, IG2, IB2, and IW2 has a high luminance level at that portion. The white (W) luminance information IW2 mainly has a high luminance level in the left side of the boundary BL, while the green (G) luminance information IG2 has a high luminance level in the right side of the boundary BL. Calculation of the luminance information IW3 at a position PP1 is now described.

First, the interpolation processing section 24 extracts the luminance information IW2 among the pieces of luminance information IR2, IG2, IB2, and IW2 contained in the image signal Sp23, and creates a luminance information map MAP based on the luminance information IW2. The interpolation processing section 24 uses the luminance information map MAP to perform interpolation processing, and thus obtains the luminance information IW3.

Figure 17:
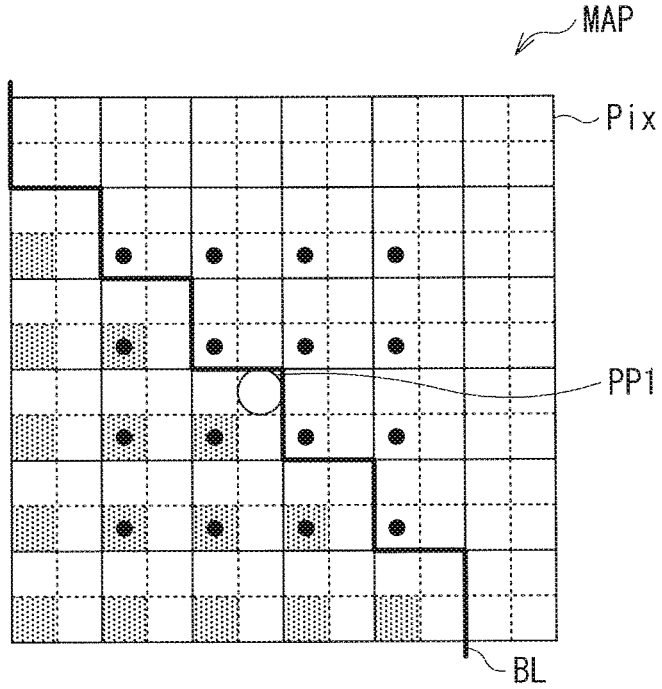
FIG. 17 is an explanatory diagram for explaining exemplary operation of an interpolation processing section illustrated in FIG. 1.

FIG. 17 illustrates interpolation processing at a position PP1 in the boundary portion P1. In the luminance information map MAP, the luminance information IW2 is disposed at a lower left position (a position of the green (G) sub-pixel SPix) in each pixel Pix. Specifically, four pieces of luminance information IR2, IG2, IB2, and IW2 of a pixel Pix originally indicate respective colors of luminance information at one point. In this exemplary case, it is therefore assumed that a position of the sub-pixel SPix of green (G), for which the luminosity factor is highest among the basic colors of red (R), green (G), and blue (B), is that point, and the four pieces of luminance information IR2, IG2, IB2, and IW2 are disposed at that point.

The interpolation processing section 24 performs interpolation processing based on a plurality of pieces of luminance information IW2 around the position PP1. In this exemplary case, the interpolation processing section 24 obtains the luminance information IW3 at the position PP1 (a position of the white (W) sub-pixel SPix) based on 16 (=4×4) pieces of luminance information IW2 each being disposed at a lower left position (a position of the green (G) sub-pixel SPix) in each pixel Pix. Examples of a usable interpolation method may include a bicubic method. The luminance information IW3 at the position PP1, which is obtained through such interpolation processing, may have a substantially halftone level, for example.

Figure 18:
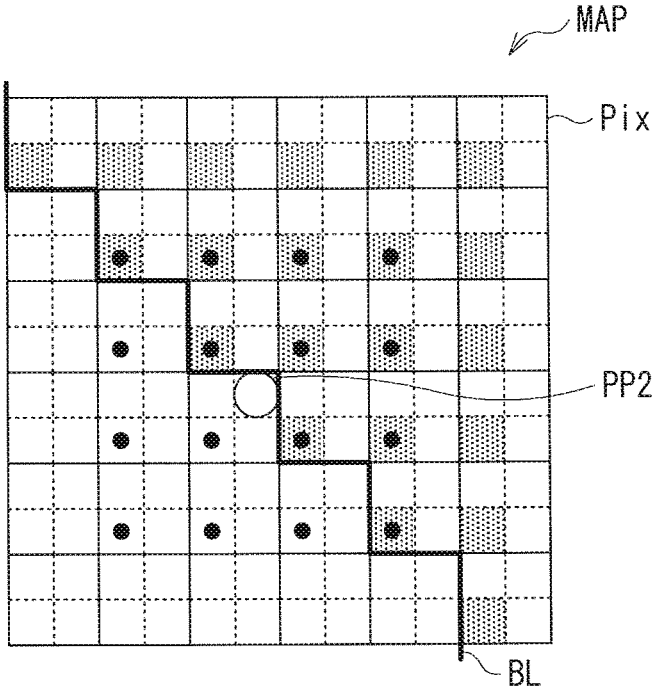
FIG. 18 is an explanatory diagram for explaining exemplary operation of an interpolation processing section illustrated in FIG. 1.

FIG. 18 illustrates interpolation processing at a position PP2 in the boundary portion P2. As with the boundary portion P1 (FIG. 17), the interpolation processing section 24 obtains the luminance information IW3 at the position PP2 (a position of the white (W) sub-pixel SPix) based on 16 (=4×4) pieces of luminance information IW2 each being disposed at a lower left position (a position of the green (G) sub-pixel SPix) in each pixel Pix. The luminance information IW3 at the position PP2, which is obtained through such interpolation processing, may have a substantially halftone level, for example.

Figure 19:
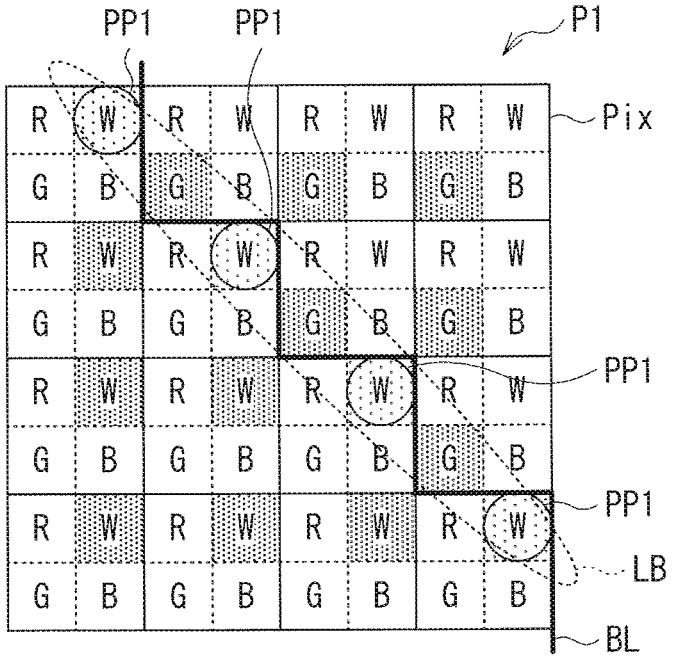
FIG. 19 is an explanatory diagram for explaining exemplary operation of a sub-pixel after interpolation processing.

FIG. 19 illustrates luminance of each sub-pixel SPix in the boundary portion P1. In FIG. 19, a shaded sub-pixel SPix indicates a sub-pixel SPix that emits light. As described above, since the luminance information IW3 at the position PP1 has a substantially halftone level through the interpolation processing, luminance of the bright line LB is decreased. In this way, through the interpolation processing, the bright line LB is allowed to be less noticeable compared with the case of the comparative example (FIG. 14).

Figure 20:
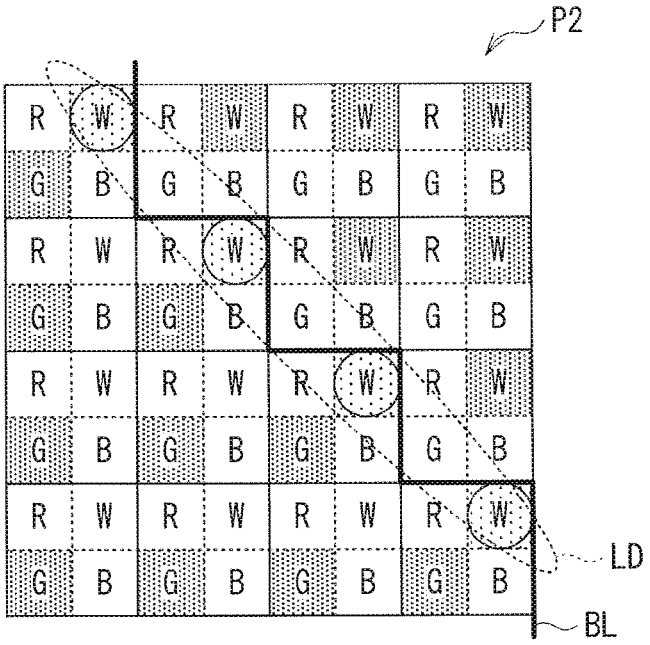
FIG. 20 is an explanatory diagram for explaining another type of exemplary operation of a sub-pixel after interpolation processing.

FIG. 20 illustrates luminance of each sub-pixel SPix in the boundary portion P2. As described above, since the luminance information IW3 at the position PP2 has a substantially halftone level through the interpolation processing, luminance of the dark line LD is increased. In this way, through the interpolation processing, the dark line LD is allowed to be less noticeable compared with the case of the comparative example (FIG. 15).

In the display 1, the interpolation processing section 24 performs the interpolation processing in this way. This allows luminance of the bright line LB to be decreased while allowing luminance of the dark line LD to be increased in the neighborhood between the green region and the white region, and thus allows the bright line LB and the dark line LD to be less noticeable. Furthermore, the RGBW conversion section 23 smooths the W conversion rate Gw in a frame image F; hence, sub-pixels SPix of white (W) and sub-pixels SPix of green (G) are allowed to emit light at luminance levels substantially equal to each other, and thus luminance is dispersed over a plurality of sub-pixels SPix in the neighborhood of the boundary, thus allowing the bright line LB and the dark line LD to be less noticeable.

[Effects]

As described above, in the first embodiment, since interpolation processing is performed on white luminance information, the bright line and the dark line are allowed to be less noticeable in the neighborhood of the boundary between the green region and the white region, thus making it possible to improve image quality.

In the first embodiment, the W conversion rate is obtained for each pixel, and the W conversion rate is smoothed in a frame image F; hence, luminance is dispersed over a plurality of sub-pixels in the neighborhood of the boundary between the green region and the white region, thus allowing the bright line and the dark line to be less noticeable, and allowing image quality to be improved.

[Modification 1-1]

Although the Gw calculating section 33 calculates the W conversion rate Gw using the lookup table in the first embodiment, this is not limitative. Alternatively, for example, the W conversion rate Gw may be calculated using a function.

2. Second Embodiment

A display 2 according to a second embodiment is now described. In the second embodiment, the smoothing process and the interpolation processing of the present technology are performed only in a horizontal direction. It is to be noted that substantially the same components as those of the display 1 according to the first embodiment are designated by the same numerals, and description of them is appropriately omitted.

Figure 21:
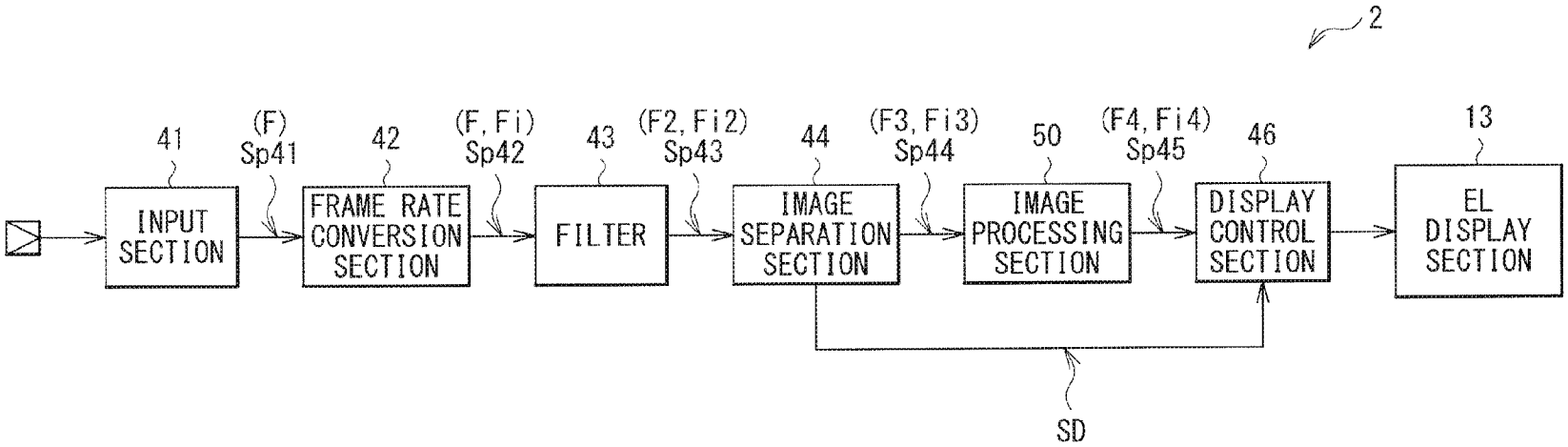
FIG. 21 is a block diagram illustrating an exemplary configuration of a display according to a second embodiment of the present disclosure.

FIG. 21 illustrates an exemplary configuration of the display 2. The display 2 includes an input section 41, a frame rate conversion section 42, a filter 43, an image separation section 44, an image processing section 50, and a display control section 46.

The input section 41 is an input interface that is configured to generate an image signal Sp41 based on an image signal supplied from an external unit, and outputs the image signal Sp41. In this exemplary case, the image signal supplied to the display 2 is a progressive signal at 60 frames per second. The image signal to be supplied is not limited thereto. Alternatively, the image signal may have a frame rate of, for example, 50 frames per second.

The frame rate conversion section 42 performs frame rate conversion based on the image signal Sp41 supplied from the input section 41 to generate an image signal Sp42. In the frame rate conversion in this exemplary case, the frame rate is converted into a frame rate two times the original frame rate, i.e., converted from 60 frames/sec into 120 frames/sec.

Figure 22A:
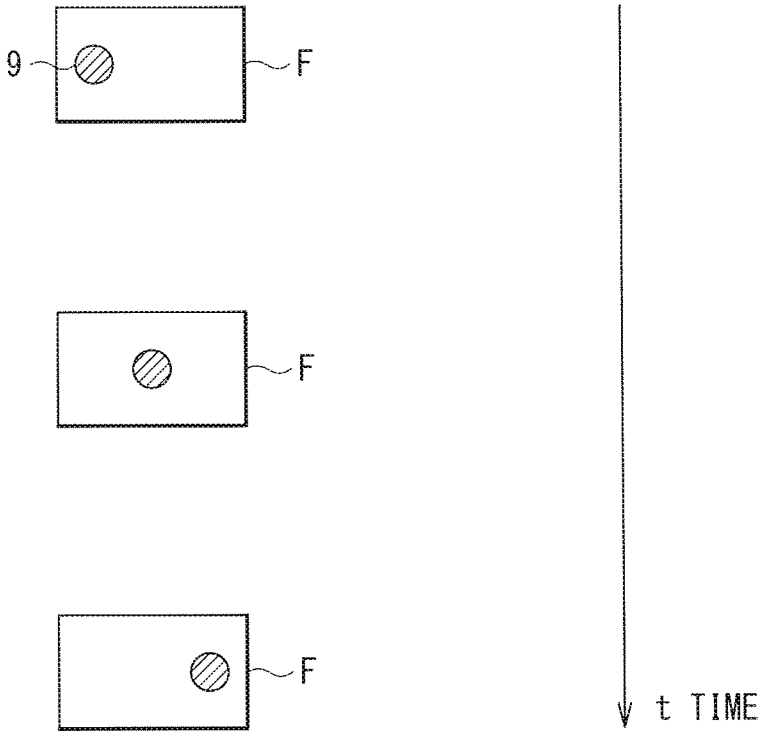
FIG. 22A is an explanatory diagram illustrating frame images before frame rate conversion.
Figure 22B:
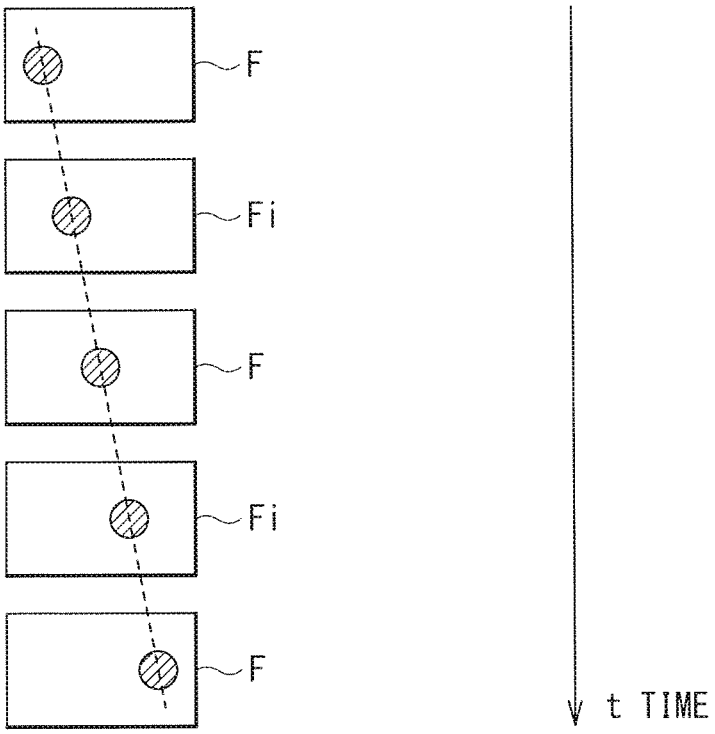
FIG. 22B is an explanatory diagram illustrating frame images after frame rate conversion.

FIG. 22A illustrates images before frame rate conversion. FIG. 22B illustrates images after frame rate conversion. The frame rate conversion is performed as follows: frame interpolation processing is performed on a temporal axis based on two frame images F that are adjacent to each other on the temporal axis to form a frame image Fi, and the frame image Fi is inserted between such adjacent frame images F. The frame images F and Fi are each an image configured of the same number of pieces of luminance information as the number of pixels of the EL display section 13. For example, in the case of an image of a ball 9 moving from the left to the right as illustrated in FIG. 22A, a frame image Fi is inserted between adjacent frame images F so that the ball 9 moves more smoothly as illustrated in FIG. 22B. Moreover, while so-called hold blur may occur due to holding of a certain state of a pixel for a period of one frame in the EL display section 13, influence of such hold blur is allowed to be reduced through insertion of the frame image Fi.

The filter 43 is configured to smooth luminance information for each pixel between lines on the frame images F and Fi contained in the image signal Sp42 to form frame images F2 and Fi2, respectively, and output the frame images F2 and Fi2 in a form of an image signal Sp43. Specifically, in this exemplary case, the filter 43 is configured of a 3-tap finite impulse response (FIR) filter. Description is now made on an exemplary case where smoothing is performed on a frame image F. It is to be noted that the same holds true in the case where smoothing is performed on a frame image Fi.

Figure 23:
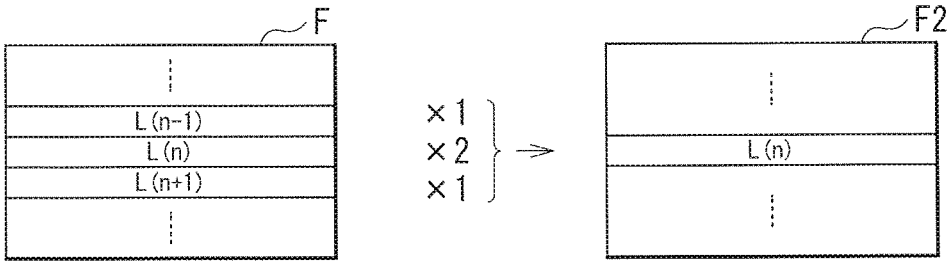
FIG. 23 is a schematic diagram illustrating exemplary operation of a filter illustrated in FIG. 21.

FIG. 23 illustrates operation of the filter 43. In this exemplary case, the filter coefficients of the taps are set to a ratio of 1:2:1. The filter 43 performs smoothing on pieces of luminance information of three adjacent lines in a frame image F to generate luminance information for one line. Specifically, for example, the filter 43 weighs pieces of luminance information of three lines L(n−1), L(n), and L(n+1) into 1:2:1 to form a line image L(n) of a frame image F2. Similarly, the filter 43 weighs pieces of luminance information of three lines L(n), L(n+1), and L(n+2) into 1:2:1 to form a line image L(n+1) of a frame image F2. In this way, the filter 43 smooths the frame image F to form the frame image F2.

The image separation section 44 is configured to separate an image F3 from the frame image F2 contained in the image signal Sp43 and separate an image Fi3 from the frame image Fi2 contained in the image signal Sp43, and output the images F3 and Fi3 in a form of an image signal Sp44.

Figure 24A:
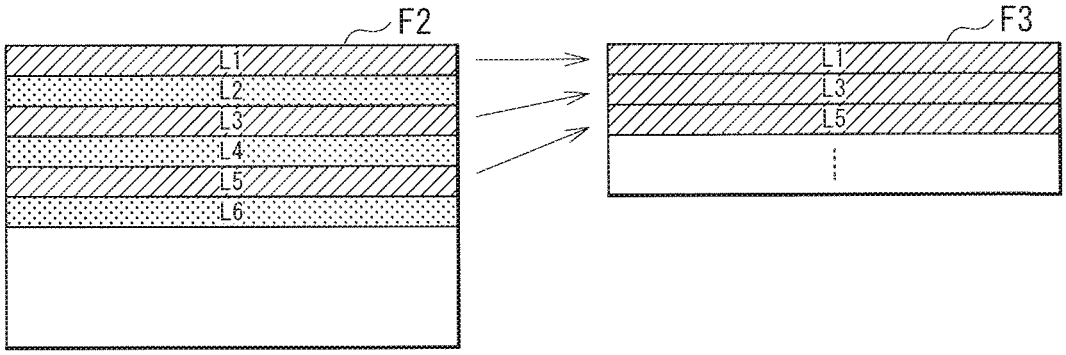
FIG. 24A is a schematic diagram illustrating exemplary operation of an image separation section illustrated in FIG. 21.
Figure 24B:
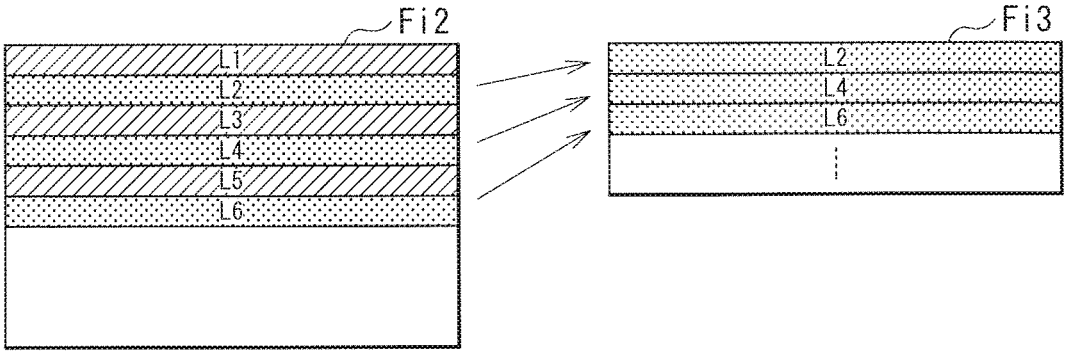
FIG. 24B is a schematic diagram illustrating another type of exemplary operation of the image separation section illustrated in FIG. 21.

FIG. 24A illustrates operation of separating the image F3 from the frame image F2. FIG. 24B illustrates operation of separating the image Fi3 from the frame image Fi2. As illustrated in FIG. 24A, the image separation section 44 separates each line image L of each odd line from the frame image F2 contained in the image signal Sp43 to form the image F3 configured of the line images L of the odd lines. Specifically, the image F3 is configured of a line image L1 of a first line, a line image L3 of a third line, a line image L5 of a fifth line, etc., of the frame image F2. The number of lines of the image F3 is half the number of lines of the frame image F2. Similarly, as illustrated in FIG. 24B, the image separation section 44 separates each line image L of each even line from the frame image Fi2 contained in the image signal Sp43 to form the image Fi3 configured of the line images L of the even lines. Specifically, the image Fi3 is configured of a line image L2 of a second line, a line image L4 of a fourth line, a line image L6 of a sixth line, etc., of the frame image Fi2. The number of lines of the image Fi3 is half the number of lines of the frame image Fi2.

The image separation section 44 further has a function of generating a determination signal SD that indicates whether a formed image is the image F3 or the image Fi3 when the image F3 or Fi3 is formed through such image separation. Specifically, the determination signal SD indicates whether an image formed by the image separation section 44 is the image F3 configured of line images L of odd lines of the frame image F2 or the image Fi3 configured of line images L of even lines of the frame image Fi2.

The image processing section 50 is configured to perform predetermined types of image processing such as RGBW conversion processing and interpolation processing based on the image signal Sp44, and output such processed results in a form of an image signal Sp45, as with the image processing section 20 according to the first embodiment. Specifically, the image processing section 50 is configured to perform the predetermined types of image processing on the image F3 contained in the image signal Sp44 to form an image F4, and perform the predetermined types of image processing on the image Fi3 contained in the image signal Sp44 to form an image Fi4, and output the images F4 and Fi4 in a form of the image signal Sp45. The image processing section 50 includes an RGBW conversion section 53 and an interpolation processing section 54 as illustrated in FIG. 1.

The RGBW conversion section 53 includes a filter section 34B as illustrated in FIG. 3. The filter section 34B is configured to smooth the W conversion rate Gw for each pixel supplied from the Gw calculating section 33 in a horizontal direction in a frame image, and output the smoothed W conversion rate as a W conversion rate Gw2 for each pixel. In other words, although the filter section 34 according to the first embodiment smooths the W conversion rate Gw in the horizontal and vertical directions in a frame image, the filter section 34B according to the second embodiment smooths the W conversion rate Gw only in the horizontal direction in a frame image.

The interpolation processing section 54 is configured to interpolate luminance information IW2 contained in the image signal Sp23 using luminance information IW2 of each of pixels arranged in a horizontal direction with respect to a focused pixel in a frame image F. Specifically, although the interpolation processing section 24 according to the first embodiment interpolates each luminance information IW2 contained in the image signal Sp23 using luminance information IW2 of each of pixels arranged in the horizontal and vertical directions with respect to a focused pixel, the interpolation processing section 54 according to the second embodiment interpolates the luminance information IW2 using luminance information IW2 of each of pixels arranged in the horizontal direction with respect to a focused pixel.

The display control section 46 is configured to perform timing control of display operation of the EL display section 13 based on the image signal Sp45 and the determination signal SD. Specifically, when the display control section 46 controls the EL display section 13 based on the images F4 and Fi4 contained in the image signal Sp45, the display control section 46 performs such control such that scan drive is differently performed between the image F4 and the image Fi4 according to the determination signal SD.

Figure 25A:
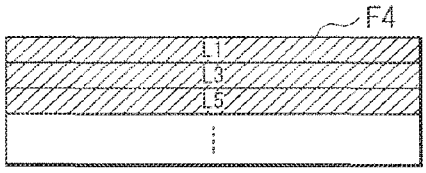
FIG. 25A and FIG. 25B are schematic diagrams illustrating exemplary operation of a display control section illustrated in FIG. 21.
Figure 25B:
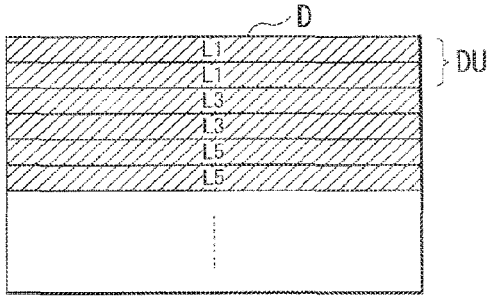
Figure 25C:
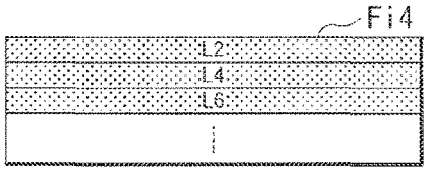
FIG. 25C and FIG. 25D are schematic diagrams illustrating another type of exemplary operation of the display control section illustrated in FIG. 21.
Figure 25D:
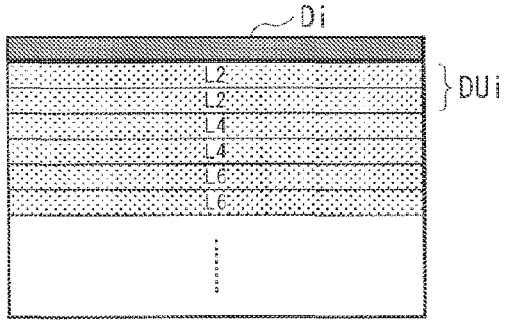

FIG. 25A and FIG. 25B schematically illustrate the control operation of the display control section 46 in the case of displaying the image F4. FIG. 25C and FIG. 25D schematically illustrate the control operation of the display control section 46 in the case of displaying the image Fi4. First, the display control section 46 determines whether an image supplied by the image signal Sp45 is the image F4 or the image Fi4 based on the determination signal SD. If the display control section 46 determines the image F4 is supplied, as illustrated in FIG. 25A, the display control section 46 performs control such that a line image L1 is written into first and second lines of the EL display section 13 within the same horizontal period, a line image L3 is written into third and fourth lines of the EL display section 13 within the same horizontal period, and other line images are also written in the same way, as illustrated in FIG. 25B. In other words, the display control section 46 performs control such that the EL display section 13 is scanned at every two lines (at every drive unit DU). If the display control section 46 determines the image Fi4 is supplied, as illustrated in FIG. 25C, the display control section 46 may perform control such that, for example, black information (luminance information of zero) is written into a first line of the EL display section 13, a line image L2 is written into second and third lines of the EL display section 13 within the same horizontal period, a line image L4 is written into fourth and fifth lines of the EL display section 13 within the same horizontal period, and other line images are also written in the same way, as illustrated in FIG. 25D. In other words, the display control section 46 performs control such that the EL display section 13 is scanned at every two lines (at every drive unit DUi).

In this operation, as illustrated in FIGS. 25A, 25B, 25C, and 25D, the display control section 46 performs control such that the drive unit DU for display of the image F4 is offset from the drive unit DUi for display of the image Fi4. Specifically, for example, the drive unit DU may correspond to the first and second lines of the EL display section 13, while the drive unit DUi may correspond to the second and third lines of the EL display section 13, and thus the drive units DU and Dui may be offset by one line from each other. Consequently, the display 2 suppresses reduction in resolution in a vertical direction.

Figure 26:
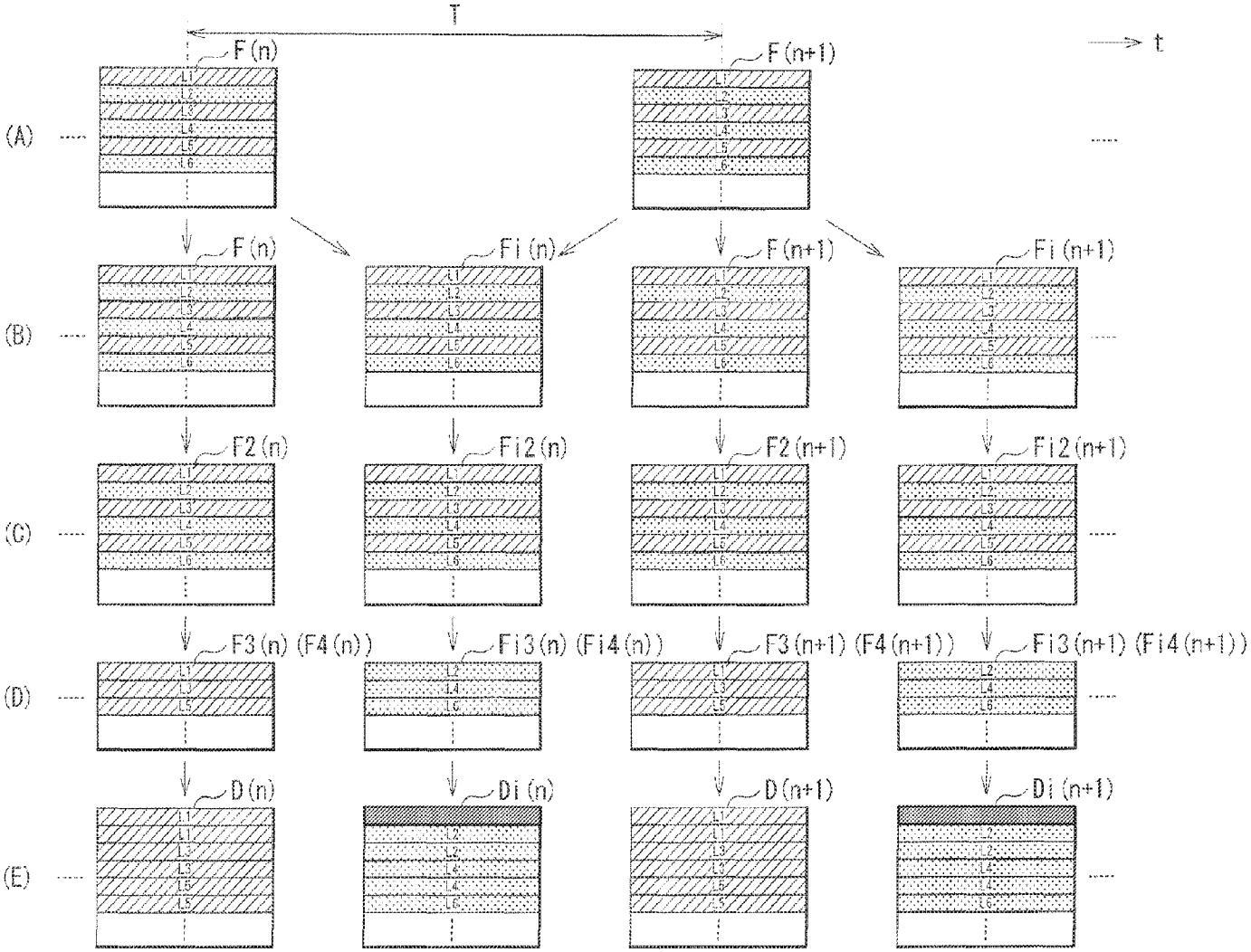
FIG. 26 is a schematic diagram illustrating exemplary operation of the display illustrated in FIG. 21.

FIG. 26 schematically illustrates detailed operation of the display 2, where (A) illustrates a frame image F contained in the image signal Sp41, (B) illustrates frame images F and Fi contained in the image signal Sp42, (C) illustrates frame images F2 and Fi2 contained in the image signal Sp43, (D) illustrates frame images F3 and Fi3 contained in the image signal Sp44, and (E) illustrates display images D and Di on the EL display section 13. For example, F(n) indicates an nth frame image F, and F(n+1) indicates an (n+1)th frame image F supplied following the frame image F(n). The frame image F is supplied in a period T (for example, 16.7 [msec]=1/60 [Hz]).

First, as illustrated in (B) of FIG. 26, the frame rate conversion section 42 converts the frame rate of the image signal Sp41 into a frame rate two times the original frame rate. Specifically, for example, the frame rate conversion section 42 forms a frame image Fi(n) ((B) of FIG. 26) through frame interpolation processing based on frame images F(n) and F(n+1) ((A) of FIG. 26) adjacent to each other on a temporal axis. The frame rate conversion section 42 inserts the frame image Fi(n) between the frame images F(n) and F(n+1).

Subsequently, as illustrated in (C) of FIG. 26, the filter 43 smooths the pieces of luminance information of the frame images F and Fi between lines to form the frame images F2 and Fi2, respectively. Specifically, for example, the filter 43 may perform smoothing on the frame image F(n) ((B) of FIG. 26) to form a frame image F2(*n*) ((C) of FIG. 26), and may perform smoothing on the frame image Fi(n) ((B) of FIG. 26) to form a frame image Fi2(*n*) ((C) of FIG. 26).

Subsequently, as illustrated in (D) of FIG. 26, the image separation section 44 separates each line image L of each odd line from the frame image F2, and separates each line image L of each even line from the frame image Fi2. Specifically, for example, the image separation section 44 separates the line images L1, L3, L5, . . . of odd lines from the frame image F2(*n*) ((C) of FIG. 26) to form the frame image F3(*n*) ((D) of FIG. 26), and separates the line images L2, L4, L6, . . . of even lines from the frame image Fi2(*n*) ((C) of FIG. 26) to form the frame image Fi3(*n*) ((D) of FIG. 26).

Subsequently, the image processing section 50 performs predetermined image processing on the frame images F3 and Fi3 to form the frame images F4 and Fi4, respectively, ((D) of FIG. 26).

As illustrated in (E) of FIG. 26, the display control section 46 controls display operation of the EL display section 13 based on the frame images F4 and Fi4 and the determination signal SD. Specifically, for example, based on the determination signal SD and the image F4(*n*) ((D) of FIG. 26) containing the line images L1, L3, and L5 of odd lines, the display control section 46 may perform control such that the line image L1 is written into the first and second lines of the EL display section 13 in the same horizontal period, the line image L3 is written into the third and fourth lines of the EL display section 13 in the same horizontal period, and other line images are also written in the same way. The EL display section 13 displays a display image D(n) based on such control ((E) of FIG. 26). Similarly, for example, based on the determination signal SD and the image Fi4(*n*) ((D) of FIG. 26) containing the line images L2, L4, and L6 of even lines, the display control section 46 may perform control such that, for example, black information (luminance information of zero) is written into the first line of the EL display section 13, the line image L2 is written into the second and third lines of the EL display section 13 within the same horizontal period, the line image L4 is written into the fourth and fifth lines of the EL display section 13 within the same horizontal period, and other line images are also written in the same way. The EL display section 13 displays a display image Di(n) based on such control ((E) of FIG. 26).

In this way, in the display 2, scan drive is performed at every two lines based on the line images L of odd lines of the frame image F to display the display image D, while scan drive is performed at every two lines while being offset by one line from the scan drive on the frame image F based on the line images L of even lines of the frame image Fi formed through the frame interpolation processing, and the display image Di is displayed. The display image D and the display image Di are alternately displayed. Consequently, a viewer views an average image of the display images D and Di.

At this time, scan drive is performed at every two lines in the display 2. Hence, for example, even if a high-definition display device is used as the EL display section 13, sufficient time length of each horizontal period is secured, thus making it possible to suppress reduction in image quality. Specifically, for example, if scan drive is performed at every one line, since a horizontal period is shorter with higher definition of the display section, a sufficient horizontal period is not secured, leading to a possibility of reduction in image quality. In contrast, in the display 2, scan drive is performed at every two lines, and therefore a longer horizontal period is allowed to be secured, thus making it possible to reduce the possibility of reduction in image quality.

Furthermore, in the display 2, the drive units DU and DUi are offset from each other so that the display image D and the display image Di, which are offset by one line from each other, are alternately displayed, thus making it possible to suppress reduction in resolution.

As described above, in the second embodiment, since scan drive is performed at every two lines, sufficient time length of each horizontal period is allowed to be secured, thus making it possible to suppress reduction in image quality.

Furthermore, in the second embodiment, the drive units DU and DUi are offset from each other so that the display image D and the display image Di, which are offset by one line from each other, are alternately displayed, thus making it possible to suppress reduction in resolution, and suppress reduction in image quality.

Furthermore, in the second embodiment, the smoothing process by the RGBW conversion section and the interpolation processing by the interpolation processing section are performed only in the horizontal direction, thus making it possible to improve image quality as with the first embodiment.

3. Application Examples

Application examples of each of the displays described in the above-described embodiments and the Modification are now described.

Figure 27:
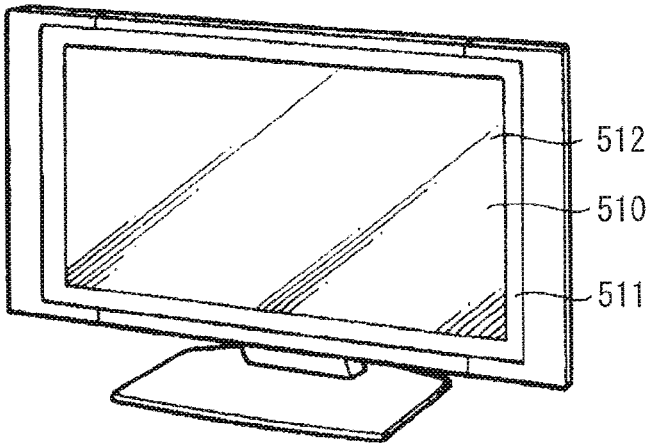
FIG. 27 is a perspective diagram illustrating an appearance configuration of a television unit to which the display according to any of the example embodiments is applied.

FIG. 27 illustrates appearance of a television unit to which any of the displays according to the above-described embodiments and the Modification is applied. This television unit may have, for example, an image display screen section 510 including a front panel 511 and filter glass 512. The image display screen section 510 is configured of the display according to any of the above-described embodiments and the Modification.

The display according to any of the above-described embodiments and the Modification is applicable to an electronic apparatus in any field. In addition to the television unit, examples of the electronic apparatus may include a digital camera, a notebook personal computer, a mobile terminal unit such as a mobile phone, a portable video game player, and a video camera. In other words, the display unit according to any of the above-described embodiments and the Modification is applicable to an electronic apparatus that displays images in any field.

Although the present technology has been described with reference to the example embodiments, the Modification, and the application examples directed to an electronic apparatus hereinbefore, the technology is not limited thereto, and various modifications or alterations thereof may be made.

For example, although the filter section 34 smooths the W conversion rate Gw in horizontal and vertical directions in a frame image in the above-described first embodiment and the Modification thereof, this is not limitative. Alternatively, for example, the display may be configured such that a mode of smoothing in horizontal and vertical directions, a mode of smoothing in a horizontal direction, and a mode of smoothing in a vertical direction are prepared, and one of such modes may be selectively used.

Similarly, for example, although the interpolation processing section 24 interpolates the luminance information IW2 contained in the image signal Sp23 using luminance information IW2 of each of pixels arranged in horizontal and vertical directions with respect to a focused pixel in the above-described first embodiment and the Modification thereof, this is not limitative. Alternatively, for example, the display may be configured such that a mode of interpolation using luminance information IW2 of each of pixels arranged in horizontal and vertical directions, a mode of interpolation using luminance information IW2 of each of pixels arranged in a horizontal direction, and a mode of interpolation using luminance information IW2 of each of pixels arranged in a vertical direction are prepared, and one of such modes may be selectively used.

Figure 28:
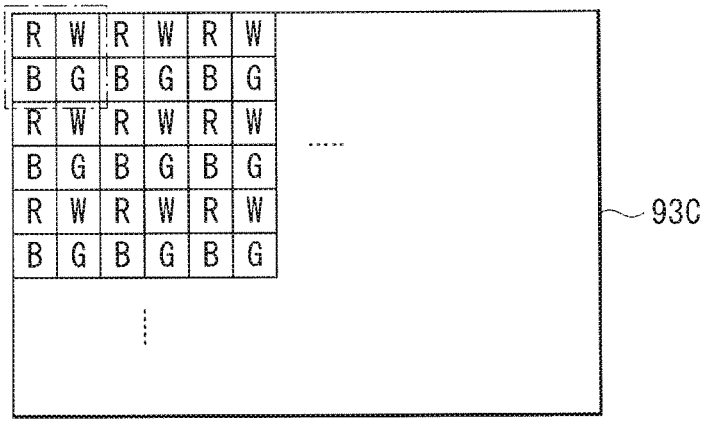
FIG. 28 is an explanatory diagram illustrating an exemplary configuration of a pixel array section according to a Modification.
Figure 29:
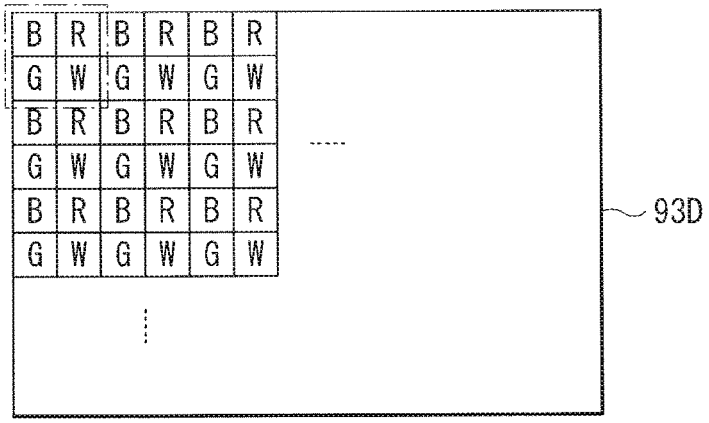
FIG. 29 is an explanatory diagram illustrating an exemplary configuration of a pixel array section according to another Modification.

Moreover, although the sub-pixels SPix of white (W) and green (G), the luminosity factor for each of which is high, are disposed so as to be arranged in an oblique direction in each pixel Pix of the pixel array section 93 in the above-described embodiments and the Modification, this is not limitative. Alternatively, for example, as illustrated in FIG. 28, the sub-pixels SPix of white (W) and green (G) may be disposed so as to be arranged in a vertical (longitudinal) direction. In each pixel Pix in a pixel array section 93C according to this Modification, a red (R) sub-pixel SPix is disposed at the upper left, a blue (B) sub-pixel SPix is disposed at the lower left, a white (W) sub-pixel SPix is disposed at the upper right, and a green (G) sub-pixel SPix is disposed at the lower right. Alternatively, for example, as illustrated in FIG. 29, the sub-pixels SPix of white (W) and green (G) may be disposed so as to be arranged in a horizontal (lateral) direction. In each pixel Pix in a pixel array section 93D according to this Modification, a blue (B) sub-pixel SPix is disposed at the upper left, a green (G) sub-pixel SPix is disposed at the lower left, a red (R) sub-pixel SPix is disposed at the upper right, and a white (W) sub-pixel SPix is disposed at the lower right.

Figure 30:
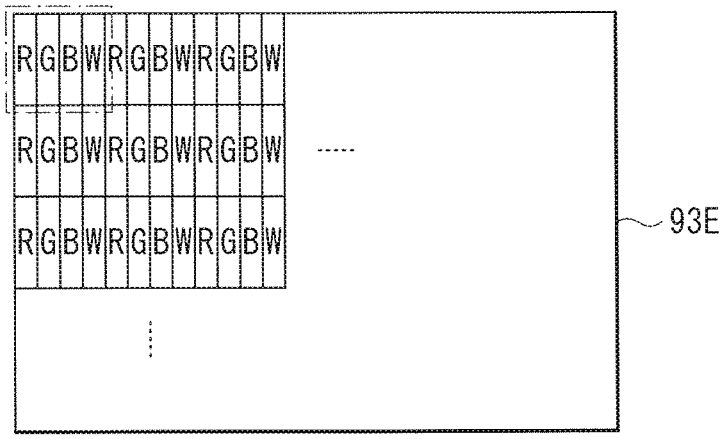
FIG. 30 is an explanatory diagram illustrating an exemplary configuration of a pixel array section according to another Modification.

Moreover, although such four sub-pixels SPix are arranged in 2×2 in a pixel Pix in the above-described embodiments and the Modification, this is not limitative. Alternatively, as illustrated in FIG. 30, four sub-pixels SPix each extending in a vertical (longitudinal) direction may be arranged side-by-side in a horizontal (lateral) direction. In a pixel array section 93E according to this Modification, sub-pixels SPix of red (R), green (G), blue (B), and white (W) are arranged in this order from the left in a pixel Pix.

Moreover, for example, although the present technology is applied to an EL display in the above-described embodiments and the Modification, this is not limitative. Alternatively, for example, the technology may be applied to a liquid crystal display.

Furthermore, the technology encompasses any possible combination of some or all of the various embodiments described herein and incorporated herein.

It is possible to achieve at least the following configurations from the above-described example embodiments of the disclosure.

(1) A display, including:

a display section including a plurality of display pixels each having a first sub-pixel, a second sub-pixel, and a third sub-pixel that are configured to emit light of basic colors, and a fourth sub-pixel that is configured to emit light of a color other than the basic colors; and a processing section configured to obtain, based on a plurality of pieces of first luminance information that correspond to the fourth sub-pixels contained in a pixel region to which a focused pixel among the display pixels belongs and based on a relative positional relationship between the first sub-pixel and the fourth sub-pixel in the display pixel, second luminance information that corresponds to the fourth sub-pixel of the focused pixel, and configured to replace the first luminance information that corresponds to the fourth sub-pixel of the focused pixel with the second luminance information.

(2) The display according to (1), wherein the processing section creates a luminance information map in which the pieces of first luminance information in the pixel region are disposed at respective positions of the first sub-pixels, and obtains, based on the luminance information map and through interpolation, the second luminance information at a position of the fourth sub-pixel of the focused pixel.

(3) The display according to (1) or (2), further including a luminance information generation section configured to obtain, based on three pieces of first basic luminance information that correspond to the respective first sub-pixel, the second sub-pixel, and the third sub-pixel of each of the display pixels, a light emission rate of the fourth sub-pixel of the display pixel, and configured to obtain, based on the light emission rate and the three pieces of first basic luminance information, the first luminance information of that display pixel.

(4) The display according to (3), wherein the luminance information generation section obtains the light emission rate, based on luminance information having a smallest value among the three pieces of first basic luminance information.

(5) The display according to (4), wherein the light emission rate is low when the luminance information having the smallest value has a low luminance level, and is high when the luminance information having the smallest value has a high luminance level.

(6) The display according to any one of (3) to (5), wherein the luminance information generation section smooths the light emission rate between the display pixels, and obtains, based on the smoothed light emission rate and the three pieces of first basic luminance information, the first luminance information.

(7) The display according to any one of (3) to (6), wherein the luminance information generation section generates three pieces of second basic luminance information that correspond to the three pieces of first basic luminance information, based on the light emission rate and the three pieces of first basic luminance information.

(8) The display according to any one of (1) to (7), wherein a luminosity factor for the color light emitted by the first sub-pixel is substantially equal to or higher than a luminosity factor for the color light emitted by the second sub-pixel, and is substantially equal to or higher than a luminosity factor for the color light emitted by the third sub-pixel.

(9) The display according to any one of (1) to (8), wherein the first sub-pixel, the second sub-pixel, and the third sub-pixel emit the color light of green, red, and blue, respectively, and a luminosity factor for the color light emitted by the fourth sub-pixel is substantially equal to or higher than a luminosity factor for the green color light emitted by the first sub-pixel.

(10) The display according to (9), wherein the fourth sub-pixel emits white color light.

(11) An image processing unit, including a processing section configured to obtain, based on a plurality of pieces of first luminance information that correspond to fourth sub-pixels contained in a pixel region to which a focused pixel belongs and based on a relative positional relationship between a first sub-pixel and the fourth sub-pixel in a display pixel, second luminance information that corresponds to the fourth sub-pixel of the focused pixel, the focused pixel being a display pixel in a display section that includes a plurality of display pixels each having the first sub-pixel, a second sub-pixel, and a third sub-pixel that are configured to emit light of basic colors, and the fourth sub-pixel that is configured to emit light of a color other than the basic colors, and configured to replace the first luminance information that corresponds to the fourth sub-pixel of the focused pixel with the second luminance information.

(12) An image processing method, including:

obtaining, based on a plurality of pieces of first luminance information that correspond to fourth sub-pixels contained in a pixel region to which a focused pixel belongs and based on a relative positional relationship between a first sub-pixel and the fourth sub-pixel in a display pixel, second luminance information that corresponds to the fourth sub-pixel of the focused pixel, the focused pixel being a display pixel in a display section that includes a plurality of display pixels each having the first sub-pixel, a second sub-pixel, and a third sub-pixel that are configured to emit light of basic colors, and the fourth sub-pixel that is configured to emit light of a color other than the basic colors; and replacing the first luminance information that corresponds to the fourth sub-pixel of the focused pixel with the second luminance information.

(13) An electronic apparatus provided with a display and a control section configured to perform operation control on the display, the display including:

a display section including a plurality of display pixels each having a first sub-pixel, a second sub-pixel, and a third sub-pixel that are configured to emit light of basic colors, and a fourth sub-pixel that is configured to emit light of a color other than the basic colors; and a processing section configured to obtain, based on a plurality of pieces of first luminance information that correspond to the fourth sub-pixels contained in a pixel region to which a focused pixel among the display pixels belongs and based on a relative positional relationship between the first sub-pixel and the fourth sub-pixel in the display pixel, second luminance information that corresponds to the fourth sub-pixel of the focused pixel, and configured to replace the first luminance information that corresponds to the fourth sub-pixel of the focused pixel with the second luminance information.

It should be understood by those skilled in the art that various modifications, combinations, sub-combinations and alterations may occur depending on design requirements and other factors insofar as they are within the scope of the appended claims or the equivalents thereof.

What is claimed is:

1. A display, comprising:

a display section including a plurality of display pixels each having a first sub-pixel, a second sub-pixel, and a third sub-pixel that are configured to emit light of basic colors, and a fourth sub-pixel that is configured to emit light of a color other than the basic colors; and a processing section configured to obtain, using a plurality of pieces of first luminance information of the fourth sub-pixels of display pixels contained in a pixel region to which a focused pixel among the display pixels belongs and based on a relative positional relationship between one of the first sub-pixel, the second sub-pixel or the third sub-pixel and the fourth sub-pixel for each of the display pixels of the pixel region, second luminance information of the fourth sub-pixel of the focused pixel, and configured to replace the first luminance information of the fourth sub-pixel of the focused pixel with the second luminance information, wherein the plurality of pieces of first luminance information correspond to the color light emitted by the fourth sub-pixels of the display pixels.

2. The display according to claim 1, wherein the processing section is configured to create a luminance information map in which the plurality of pieces of first luminance information of the fourth sub-pixels of the display pixels in the pixel region are disposed at positions of the one of the first sub-pixels, the second sub-pixels or the third sub-pixels of the corresponding display pixel, and obtain, using the luminance information map and through interpolation, the second luminance information at a position of the fourth sub-pixel of the focused pixel.

3. The display according to claim 1, further comprising a luminance information generation section configured to obtain, based on three pieces of first basic luminance information that correspond to the respective first sub-pixel, the second sub-pixel, and the third sub-pixel of each of the display pixels of the display section, a light emission rate of the fourth sub-pixel for each of the plurality of display pixels, and configured to obtain, based on the light emission rate and the three pieces of first basic luminance information, the first luminance information of each of the plurality of display pixels.

4. The display according to claim 3, wherein the luminance information generation section is configured to obtain the light emission rate, based on luminance information having a smallest value among the three pieces of first basic luminance information.

5. The display according to claim 4, wherein the light emission rate is directly proportional to a luminance level of the luminance information having the smallest value.

6. The display according to claim 3, wherein the luminance information generation section is configured to smooth the light emission rate between the display pixels, and obtain, based on the smoothed light emission rate and the three pieces of first basic luminance information, the first luminance information.

7. The display according to claim 3, wherein the luminance information generation section is configured to generate three pieces of second basic luminance information that correspond to the three pieces of first basic luminance information, based on the light emission rate and the three pieces of first basic luminance information.

8. The display according to claim 1, wherein a luminosity factor for the color light emitted by the first sub-pixel is substantially equal to or higher than a luminosity factor for the color light emitted by the second sub-pixel, and is substantially equal to or higher than a luminosity factor for the color light emitted by the third sub-pixel.

9. The display according to claim 1, wherein the first sub-pixel, the second sub-pixel, and the third sub-pixel emit the color light of green, red, and blue, respectively, and a luminosity factor for the color light emitted by the fourth sub-pixel is substantially equal to or higher than a luminosity factor for the green color light emitted by the first sub-pixel.

10. The display according to claim 9, wherein the fourth sub-pixel emits white color light.

11. An image processing unit, comprising a processing section configured to obtain, using a plurality of pieces of first luminance information of fourth sub-pixels of display pixels contained in a pixel region to which a focused pixel belongs and based on a relative positional relationship between one of a first sub-pixel a second sub-pixel or a third sub-pixel and the fourth sub-pixel for each of the display pixels of the pixel region, second luminance information of the fourth sub-pixel of the focused pixel, the focused pixel being a display pixel in a display section that includes a plurality of display pixels each having the first sub-pixel, the second sub-pixel, and the third sub-pixel that are configured to emit light of basic colors, and the fourth sub-pixel that is configured to emit light of a color other than the basic colors, and configured to replace the first luminance information of the fourth sub-pixel of the focused pixel with the second luminance information, wherein the plurality of pieces of first luminance information correspond to the color light emitted by the fourth sub-pixels of the display pixels.

12. An image processing method, comprising:

obtaining, using a plurality of pieces of first luminance information of fourth sub-pixels of display pixels contained in a pixel region to which a focused pixel belongs and based on a relative positional relationship between one of a first sub-pixel, a second sub-pixel or a third sub-pixel and the fourth sub-pixel for each of the display pixels of the pixel region, second luminance information of the fourth sub-pixel of the focused pixel, the focused pixel being a display pixel in a display section that includes a plurality of display pixels each having the first sub-pixel, the second sub-pixel, and the third sub-pixel that are configured to emit light of basic colors, and the fourth sub-pixel that is configured to emit light of a color other than the basic colors; and replacing the first luminance information of the fourth sub-pixel of the focused pixel with the second luminance information, wherein the plurality of pieces of first luminance information correspond to the color light emitted by the fourth sub-pixels of the display pixels.

13. An electronic apparatus provided with a display and a control section configured to perform operation control on the display, the display comprising:

a display section including a plurality of display pixels each having a first sub-pixel, a second sub-pixel, and a third sub-pixel that are configured to emit light of basic colors, and a fourth sub-pixel that is configured to emit light of a color other than the basic colors; and a processing section configured to obtain, using a plurality of pieces of first luminance information of the fourth sub-pixels of display pixels contained in a pixel region to which a focused pixel among the display pixels belongs and based on a relative positional relationship between one of the first sub-pixel, the second sub-pixel or the third sub-pixel and the fourth sub-pixel for each of the display pixels of the pixel region, second luminance information of the fourth sub-pixel of the focused pixel, and configured to replace the first luminance information of the fourth sub-pixel of the focused pixel with the second luminance information, wherein the plurality of pieces of first luminance information corresponds to the color light emitted by the fourth sub-pixels of the display pixels.

* * * * *